US009453319B2

(12) United States Patent
Simpson et al.

(10) Patent No.: US 9,453,319 B2
(45) Date of Patent: Sep. 27, 2016

(54) SCOUR PREVENTING APPARATUS FOR HYDRAULICS STRUCTURES

(71) Applicant: APPLIED UNIVERSITY RESEARCH, INC., Blacksburg, VA (US)

(72) Inventors: Roger Lyndon Simpson, Blacksburg, VA (US); Gwibo Byun, Blacksburg, VA (US)

(73) Assignee: Applied University Research, Inc., Blacksburg, VA (US)

( * ) Notice: Subject to any disclaimer, the term of this patent is extended or adjusted under 35 U.S.C. 154(b) by 0 days.

(21) Appl. No.: 14/962,874

(22) Filed: Dec. 8, 2015

(65) Prior Publication Data

US 2016/0083925 A1 Mar. 24, 2016

Related U.S. Application Data

(63) Continuation-in-part of application No. 14/509,990, filed on Oct. 8, 2014, now abandoned.

(60) Provisional application No. 61/888,162, filed on Oct. 8, 2013.

(51) Int. Cl.

| | |
|---|---|
| ***E02D 5/60*** | (2006.01) |
| ***E02B 3/26*** | (2006.01) |
| ***E02D 5/64*** | (2006.01) |
| ***E02D 27/12*** | (2006.01) |
| ***E02D 27/52*** | (2006.01) |

(Continued)

(52) U.S. Cl.

CPC ..... *E02D 5/60* (2013.01); *E01D 19/02* (2013.01); *E01D 22/00* (2013.01); *E02D 5/64* (2013.01); *E02D 27/12* (2013.01); *E02D 27/52* (2013.01); *E02D 31/10* (2013.01)

(58) Field of Classification Search

CPC ..... E02D 5/60; E02D 31/10; E02B 3/26; E02B 3/28; E02B 17/0017; E02B 17/003

USPC ..... 405/211, 216, 212; 14/74, 75

See application file for complete search history.

(56) References Cited

U.S. PATENT DOCUMENTS

| | | | |
|---|---|---|---|
| 3,529,427 | A | 9/1970 | Titman |
| 3,830,066 | A | 8/1974 | Larsen |

(Continued)

OTHER PUBLICATIONS

Barkdoll, B.D., Ettema, R., and B. W. Melville, Countermeasures to Protect Bridge Abutments from Scour, NCHRP Report 587, pp. 1-3, 2007.

(Continued)

*Primary Examiner* — Gary Hartmann

(74) *Attorney, Agent, or Firm* — Berenato & White, LLC

(57) ABSTRACT

Several practical refinements, extensions, additions, and improvements to the manufactured three-dimensional continuous convex-concave fairing with attached vortex generators are provided. The piecewise continuously varying slope and curvature fairings provide manufacturing cost reductions, as well as cost reductions by reducing the frequency and complexity of monitoring practices for bridges and elimination of temporary fixes that require costly annual or periodic engineering studies and construction to mitigate scour on at-risk bridges. The probability of bridge failure and its associated liability to the public is totally avoided since the root cause of local scour is prevented.

20 Claims, 37 Drawing Sheets
(20 of 37 Drawing Sheet(s) Filed in Color)

(51) Int. Cl.

| | |
|---|---|
| ***E02D 31/10*** | (2006.01) |
| ***E01D 19/02*** | (2006.01) |
| ***E01D 22/00*** | (2006.01) |

(56) References Cited

U.S. PATENT DOCUMENTS

| | | | | |
|---|---|---|---|---|
| 3,844,123 | A | 10/1974 | Larsen | |
| 3,859,803 | A | 1/1975 | Pedersen et al. | |
| 3,981,038 | A * | 9/1976 | Vidal | E02D 29/0241 14/26 |
| 4,019,332 | A | 4/1977 | Lamy | |
| 4,114,394 | A | 9/1978 | Larsen | |
| 4,279,545 | A | 7/1981 | De Werk | |
| 4,365,574 | A | 12/1982 | Norminton | |
| 4,717,286 | A | 1/1988 | Loer | |
| 5,478,167 | A | 12/1995 | Oppenheimer et al. | |
| 5,673,449 | A | 10/1997 | Henriksson et al. | |
| 5,839,853 | A | 11/1998 | Oppenheimer et al. | |
| 6,890,127 | B1 | 5/2005 | Barrett et al. | |
| 7,628,569 | B2 | 12/2009 | Bonilla Gris | |
| 8,348,553 | B2 | 1/2013 | Simpson et al. | |
| 8,434,723 | B2 | 5/2013 | Simpson et al. | |
| 9,115,685 | B2 * | 8/2015 | Ross | F03B 13/264 |
| 2004/0265060 | A1 | 12/2004 | Lee et al. | |
| 2008/0101862 | A1 | 5/2008 | Mountain | |
| 2011/0016644 | A1 | 1/2011 | Jo | |
| 2012/0027526 | A1 | 2/2012 | Ferman | |
| 2012/0134753 | A1 | 5/2012 | Simpson et al. | |
| 2015/0086276 | A1 * | 3/2015 | Harbison | F15D 1/12 405/216 |
| 2016/0102441 | A1 * | 4/2016 | Simpson | E02B 3/04 405/211 |

OTHER PUBLICATIONS

Ettema, R., Yoon, Byungman, Nakato, Tatsuaki and Muste, Marian, A review of scour conditions and scour-estimation difficulties for bridge abutments, KSCE Journal of Civil Engineering, vol. 8, No. 6, pp. 643-665, 2004.

Lagasse, P., Zevenbergen, L., Schall, J., and Clopper, P., Bridge Scour and Stream Instability Countermeasures. FHWA Technical Report Hydraulic Engineering Circular (HEC)-23, (3.10~11 pp. 66-67) , 2001.

Sheppard, D.M., Demir, H., and Melville, B., Scour at Wide Piers and Long Skewed Piers, NCHRP-Report 682, p. 26, 2011.

Simpson, R. L., Full-Scale Prototype Testing and Manufacturing and Installation Plans for New Scour-Vortex-Prevention scAURTM and VorGAURTM Products for a Representative Scour-critical Bridge, NCHRP-IDEA Report 162, 2013.

Simpson, R. L., Junction Flows, Annual Review of Fluid Mechanics, vol. 33, pp. 415-443, 2001.

Tian, Q.Q., Simpson, R.L., and Lowe, K.T., A laser-based optical approach for measuring scour depth around hydraulic structures, 5th International Conference on Scour and Erosion, ASCE, San Francisco, Nov. 7-11, 2010.

Hunt, B., Monitoring Scour Critical Bridges, NCHRP Synthesis 396, pp. 1-2, 2009.

American Concrete Institute (ACI) Committee 318. "ACI 318-11: Building code requirements for Structural Concrete." ACI Standard, 2011.

Richardson, E.V. and Davies, S. R. Evaluating scour at bridges. FHWA NHI 01-001 HEC-18, Federal Highway Administration, US DOT, Washington, DC, section 1.1, 2001.

* cited by examiner

Prior
Art

SCOUR PREVENTING APPARATUS FOR HYDRAULICS STRUCTURES

CROSS-REFERENCE TO RELATED APPLICATIONS

This application is a continuation-in-part (CIP) of U.S. patent application Ser. No. 14/509,990, filed Oct. 8, 2014, which claims the priority of U.S. Provisional Patent Application No. 61/888,162, filed Oct. 8, 2013, the disclosures of which are incorporated herein by reference and to which priority is claimed.

FIELD OF THE INVENTION

The invention generally relates to the fields of civil engineering, hydraulic engineering, and soil and water conservation. More specifically, the invention relates to a manufactured device to prevent scour around hydraulic structures.

BACKGROUND

Removal of river bed substrate around bridge pier and abutment footings, also known as scour, presents a significant cost and risk in the maintenance of many bridges throughout the world. Bridge scour at the foundations of bridge piers and abutments is one of the most common causes of highway bridge failures. It has been estimated that 60% of all bridge failures result from scour and other hydraulic-related causes (Hunt, 2009). In 1973, a study by the US Federal Highway Administration (FHWA) was conducted to investigate 383 bridge failures caused by catastrophic floods, and it concluded that 25 percent involved pier damage and 72 percent involved abutment damage (Richardson and Davies, 2001). This has motivated research on the causes of scour at bridge piers and abutments (Ettema et al., 2004) and led bridge engineers to develop numerous countermeasures that attempt to reduce the risk of catastrophe. Unfortunately, all such countermeasures currently in existence and practice are temporary responses that cannot endure throughout the lifetime of the bridge and do not prevent the formation of scouring vortices, which are the root cause of local scour. Consequently, sediment such as sand and rocks from around the foundations of bridge abutments and piers is loosened and carried away by the flow during floods, which may compromise the integrity of the structure. When these temporary scour countermeasures are used for at-risk bridges, expensive monitoring technologies and support professionals are required to enable sufficient time for implementing contingency plans when failure is likely. Even designing bridge piers or abutments with the expectation of some scour is highly uncertain, since a study (Sheppard et al., 2011) showed huge uncertainties in scour data from hundreds of experiments. Other than the innovation of Simpson et al. (U.S. Pat. No. 8,348,553), none of the conservative current bridge pier and abutment footing or foundation designs prevents scouring vortices, so the probability of scour during high water or floods is present in all of those designs.

The bridge foundations in a water current (WC), such as piers (P) and abutments (A), change the local hydraulics drastically because of the generation of large-scale unsteadiness and shedding of coherent vortices, such as horseshoe vortices, by the piers and abutments. FIG. 1 is a sketch of the horseshoe vortex (HV) formed around the base of a bridge pier (P) hydraulic structure by a separating boundary layer. The horseshoe vortex (HV) has high lift and shear stress and triggers the onset of sediment scour and a scour hole (SH) is formed as shown in FIG. 1.

The flow field around a vertical-wall abutment (A) is highly three-dimensional and involves strong separated vortex flow around the abutment as shown in FIG. 2. A separation bubble (SB) is formed at the upstream corner of the abutment. Unsteady shed wake vortices (WV) are created due to the separation of the flow at the abutment corners. These wake vortices (WV) are very unsteady, are oriented approximately vertical and have low pressure at the vortex cores. These vortices act like small tornadoes, lifting up sediment from the sediment bed (SB) and creating a large scour hole (SH) behind the abutment (A) and a downstream scour hole (DSH). The down flow (DF) at the front of the abutment is produced by the large vertical stagnation pressure gradient of the approaching flow. The down flow rolls up and forms the primary vortex (PV) as shown in FIG. 2, which is similar to the formation of the horseshoe vortex around a single bridge pier. FIGS. 3 and 4 show the flowfield (FF) past a wing-wall abutment (A) and spill-through abutment (A), respectively, where deep contraction scour can occur due to vortices, high turbulence (HT), and flow separation zones (FS).

Bridge scour is comprised of three components: long-term aggradations and degradation of the river bed, general scour at the bridge, and local scour at the piers or abutments (Lagasse et al. 2001). The structural countermeasures are used primarily to minimize local scour, such as extended footings, scour collars, pier shape modifications, debris deflectors, and sacrificial piles, all of which are only marginally effective. A number of collar devices (Titman, U.S. Pat. No. 3,529,427; de Werk, U.S. Pat. No. 4,279,545; Larsen, U.S. Pat. No. 3,830,066; Larsen, U.S. Pat. No. 3,844,123; and Pedersen, U.S. Pat. No. 3,859,803) encircle the lower end of hydraulic structures, but do not prevent scour on the downstream side of the structure. A similar anti-scour apparatus comprising an upper and a lower collar was patented by Loer (U.S. Pat. No. 4,717,286). Larsen (U.S. Pat. No. 4,114,394) describes the use of a sheet or sack housing film material, which is secured around a hydraulic structure with cables. All of the above collar devices would only have a local effect and local scour will still happen around the vicinity of the collar, as shown by Tian et al. (2010) in work performed in the flume at Applied University Research (AUR). In U.S. Pat. No. 5,839,853 (Oppenheimer and Saunders), one structure of vortex generators, located upstream of the hydraulic structure, is specified to produce a pair of stream-wise vortices that move toward the free surface and protect the hydraulic structure from the impact of oncoming debris. Another structure of vortex generators is positioned directly in front of the hydraulic structure to prevent the streambed from scouring by counteracting the horseshoe vortex (also sometimes called the necklace vortex) formed by separation at the hydraulic structure nose if there was no control. Simpson (2001) showed that this counteracting mechanism fails as a scour countermeasure.

For abutments, Barkdoll et al. (2007) reviewed the selection and design of existing bridge abutment countermeasures for older bridges, such as parallel walls, spur dikes located locally to the abutment, and horizontal collar-type plates attached to the abutment. Two similar collar devices (Lee et al., U.S. patent Ser. No. 10/493,100; Mountain, U.S. patent Ser. No. 11/664,991) are comprised of a number of interlocking blocks or bags in a monolayer or multilayer on the stream bed around abutments. However, these horizontal collar type scour countermeasures are only marginally effective as shown in the flume test results of Tian et al. (2010).

The scour hole at the upstream abutment corner is eliminated, but the downstream scour hole due to the wake vortex shedding becomes more severe. In another approach to prevent streambed scour of a moving body of water, a scour platform is constructed by placing an excavation adjacent to the body of water (Barrett & Ruckman, U.S. Pat. No. 6,890,127). The excavation is covered with stabilizing sheet material, filled with aggregate, and extends up or downstream a desired length. However, the local scour around the excavation is inevitable, especially when the excavation is exposed to a moving body of water.

With the above prior art, Simpson et al. (U.S. Pat. No. 8,348,553) proved through model-scale and full-scale tests and disclosed a manufactured three-dimensional convex-concave fairing with attached vortex generators, for hydraulic structures such as bridge piers and abutments, whose shape prevents the local scour problem around such hydraulic structures even when the inflow is at an angle of attack to the hydraulic structure (FIGS. 5 and 6). The Simpson et al. device is effective at preventing vortices that cause substrate transport for a large range of river flow conditions and bed substrate materials because it fundamentally alters the way the river flows around the pier.

FIG. 5 shows flow around the Simpson et al. device streamlined bridge pier fairing that remains attached without the formation of vortices. The convex-concave pier fairing nose (CCPFN) is located below the faired pier nose (FPN) and prevents the formation of vortices, as does the faired side (FS). The vortex generators (VG) cause the near wall flow to be energized before it moves over the downstream convex-concave fairing (DCCF) that is below the faired downstream stern (FDS).

FIG. 6 shows a retrofit to an abutment with a faired abutment nose (FAN), a faired convex-concave abutment nose (FCCN), a faired abutment side (FS), vortex generators (VG), a downstream convex-concave fairing, using interlocking key (IK) sections. That device is a conventionally made concrete or fiber-reinforced composite, or combination of both, vortex generator equipped hydrodynamic fairing that is fit or cast over an existing or new hydraulic structure around the base of the structure and above the footing. The vortex generators (VG) are positioned so as to energize decelerating near-wall flow with higher-momentum outer layer flow. The result is a more steady compact separation and wake and substantially mitigated scour inducing wake vortical (WV) flow as shown by a computational fluid dynamics (CFD) simulation (FIG. 7).

SUMMARY OR THE INVENTION

Discussed are several practical refinements, extensions, additions, and improvements to the manufactured three-dimensional continuous convex-concave fairing with attached vortex generators that was disclosed by Simpson et al. (U.S. Pat. No. 8,348,553), which is incorporated herein by reference. The benefits include actual manufacturing cost reductions, as well as cost reductions by reducing the frequency and complexity of monitoring practices for bridges and elimination of temporary fixes that require costly annual or periodic engineering studies and construction to mitigate scour on at-risk bridges. The probability of bridge failure and its associated liability to the public is substantially avoided since the root cause of local scour is prevented.

In an extension to Simpson et al. (U.S. Pat. No. 8,348,553), in addition to the concrete or fiber-reinforced composite, or combination thereof, hydrodynamic fairing disclosed in Simpson, the present invention in practice is a cast-in-place, pre-cast, or sprayed ("shotcrete") concrete, metal, or composite, or combinations thereof, hydrodynamic fairing that is fit or cast over one or more existing or new hydraulic structures around the base of these structures and above and around their footings. Molds for the concrete or composite fairing are made from wood and other natural materials, metal or composite materials, or combinations thereof. Such a properly designed fairing prevents scouring vortex formation for both steady and unsteady flows, including oscillatory tidal flows. The vortex generators are constructed of cast-in-place, pre-cast, or sprayed ("shotcrete") concrete, metal, or composite, or combinations thereof. The product is manufactured using existing metal, concrete, and composite materials technologies well known to those skilled in the art. As such, the product can be produced at minimal cost and with high probability of endurance over a long future period.

While the shape of the Simpson et al. device for bridge piers and abutments is continuously three-dimensional, it can be approximated by piece-wise continuously varying slope and concave-convex-curvature surfaces within definable tolerances that produce the same effects as continuously varying slope and concave-convex-curvature surfaces. The term "piece-wise continuously varying" has a well-known mathematical meaning. As used herein, "piecewise continuously varying" is consistent with that well-known mathematical meaning and means that the surface is formed from an assembly of a plurality of smaller continuously varying slope and curvature surfaces, where discontinuities in slope and/or curvature occur at the intersections of the smaller continuously varying slope and curvature surfaces. In a preferred embodiment, the surface is composed of sections or pieces that individually have curvature in one direction at one location on the surface and intersect adjacent pieces or sections to form the total surface. No scouring vortices are produced with either the continuously varying slope and curvature fairing surface or a piece-wise continuously varying slope and curvature fairing surface, but the piece-wise continuously varying slope and curvature version can be manufactured at a much lower cost.

Therefore, one aspect of the present invention relates to hydraulic structure fairings, preferably having at least one vortex generator thereon. The fairing is installed around the perimeter of the hydraulic structure and extends vertically from the stream bed to a height above the stream bed. The fairing provides a faired shape in a direction of flow and includes streamlined nose and stern fairings, at least one of which has a convex shape along its horizontal planes and concave shape along its vertical planes. The convex and concave shapes intersect at each point on the surface of the streamlined nose and/or stern. Connecting the nose and stern along the direction of flow are side fairings. The nose and/or stern fairings form piecewise continuously varying slope and concave-convex curvature surfaces. The fairings are made of smaller individual pieces with continuously varying slope and curvature surfaces. When the smaller pieces are assembled, they form the fairing with piecewise continuously varying slope and curvature surfaces of the fairing.

Another aspect of the present invention relates to additional types of abutments than shown by experiments by Simpson et al. (U.S. Pat. No. 8,348,553). In addition to the square-cornered abutments discussed in that patent, tests prove that the fairing and vortex generators of the present invention also prevent scouring vortices for wing-wall and spill-through abutments.

In general, as described by Simpson et al. (U.S. Pat. No. 8,348,553), a single fully three-dimensional shape-optimized fairing with the help of vortex generators will prevent scour for a range of angles between the on-coming river flow and the pier centerline from −20° to +20°, with 0° angle defined as where the flow is aligned with the pier centerline axis or side of an abutment. The present invention provides, for bridge piers and abutments, larger angles of attack of up to 45°. Nose and tail sections on a pier may form a dogleg shape and the fairings and vortex generators prevent flow separations.

A further aspect of the present invention relates to improvements for bridge piers and abutments downstream of a bend in a river where there is large-scale swirling approach flow produced by a river bend. The fully three-dimensional shape is modified to meet the requirement of the design that the stream-wise gradient of surface vorticity flux must not exceed the vorticity diffusion or transport rate in the boundary layer, thus preventing the formation of a discrete vortex. Another requirement is that a minimal size of the fairing be used to meet the requirement that the stream-wise gradient of surface vorticity flux must not exceed the vorticity diffusion or transport rate in the boundary layer.

When a pier is in close proximity to an adjacent pier or abutment, the flow between the two hydraulic structures is at a higher speed than if they were further apart. This means that at the downstream region of the pier or abutment there will be a greater positive or adverse stream-wise pressure gradient, which will lead to more and stronger flow separation and scouring vortices. To reduce this separation and possibilities for scour, a more gradual fairing or tail may be used.

As stated by Simpson et al., one can generalize the use of vortex generators for various cases and applications. First, the vortex generators, such as the low drag asymmetric vortex generator disclosed by Simpson et al., should be located on the sides of the fairing well upstream of any adverse or positive pressure gradients and only in flow regions where there are zero pressure gradients or favorable or negative pressure gradients that will persist downstream of the vortex generator for at least one vortex generator length. This results in a well-formed vortex without flow reversal that can energize the downstream flow and prevent separation of the downstream part of the fairing. Second, the vortex generator should be at a modest angle of attack angle of the order of 10 to 20 degrees. Multiple vortex generators may be used on the sides of the fairing, as shown in FIGS. 5 and 6. The height and maximum width of the vortex generators need not be greater than the thickness of the approaching turbulent boundary layer upstream of the location of the vortex generators. The spacing between the vortex generators up the side of the fairing should be at least twice the maximum width of the vortex generator or twice the length of the vortex generator times the sine of the angle of attack, whichever is larger.

In another further aspect of the present invention, the fairing and vortex generator design features have been expanded for use around the foundation in order to further protect the foundation from the effects of contraction scour, long term degradation scour, settlement and differential settlement of footers, undermining of the concrete fairing segments, and effects of variable surrounding bed levels. Scour of the river bed away from the fairing protected pier or abutment (open-bed scour) will occur first and the river bed level will be lowered away from the pier or abutment. If the front of the foundation of a pier or abutment is exposed to approach flows, then a foundation horseshoe or scouring vortex is formed at the front which will cause local scour around the pier or abutment.

A ramp, preferably a curved ramp, may be placed in front of and attached to the foundation of a fairing protected pier to prevent the formation of the foundation horseshoe vortex and scour around an exposed foundation. A further innovation uses a vortex generator in front of each leading edge corner of the ramp, which will create a vortex that brings available loose open-bed scour materials toward the pier or abutment foundation to protect the pier or abutment. A third innovation uses vortex generators mounted on the sides of the foundation to bring more available loose open-bed scour materials toward the pier or abutment foundation to protect further the pier or abutment.

The innovative scour prevention devices in this present invention belong to the structural countermeasure category. Unlike the conventional, and prior-art before Simpson et al., structural countermeasures, the present scour countermeasure devices are based on a deep understanding of the scour mechanisms of the flow and consideration of structural and hydraulic aspects (Simpson 2001). A hydraulically optimum pier fairing constructed from any permanent solid material, whether for a straight-ahead, swirling, or curved inflow, prevents the formation of highly coherent vortices around the bridge pier or abutment and reduces 3D separation downstream of the bridge pier or abutment with the help of vortex generators, curved leading edge foundation ramp, and tail section.

In addition, these results show that the smooth flow over the pier or abutment produces lower drag force or flow resistance and lower flow blockage because low velocity swirling high blockage vortices are absent. As a result, water moves around a pier or abutment faster above the river bed, producing a lower water level at the bridge and lower over-topping frequencies on bridges during flood conditions for any water level, inflow turbulence level, or inflow swirling flow level. While tested both at model and full scale, there is no place for debris to become caught or no debris build up in front or around a pier or abutment with the fairing and vortex generator of the present invention. In cases where river or estuary boat or barge traffic occurs, the fairing can be constructed to withstand impact loads and protect piers and abutments.

The present invention addresses the FHWA's Plan of Action on scour countermeasures (Hydraulic Engineering Circular No. 23, commonly 'HEC-23'), such as avoiding adverse flow patterns, streamlining bridge elements, designing bridge pier foundations to resist scour without relying on the use of riprap or other countermeasures, etc.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
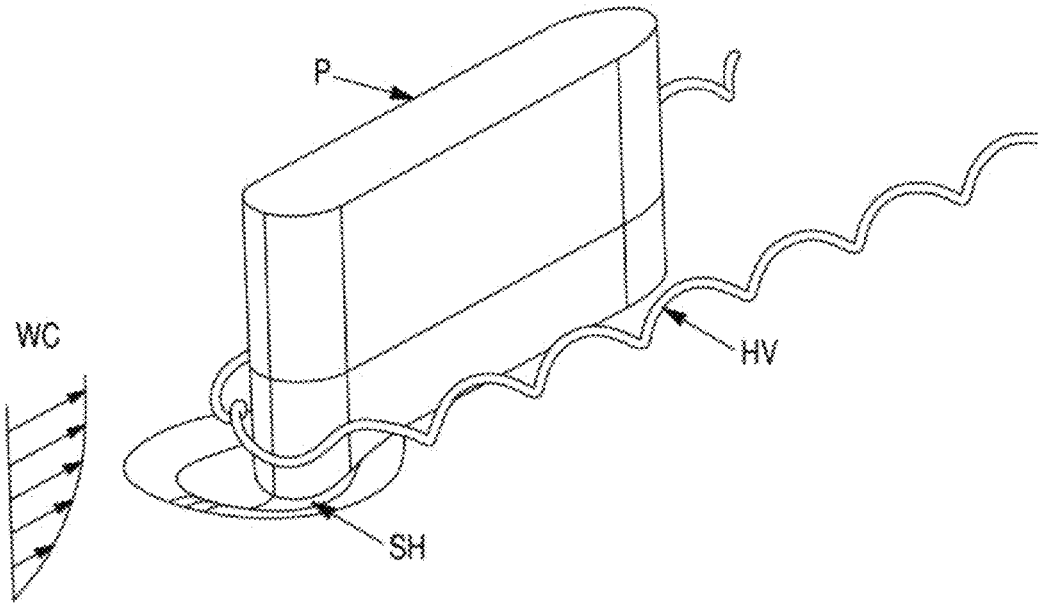
Fig. 1 Prior Art
FIGS. 1-4 (labeled "prior art") show bridge piers and abutments with no prevention of scouring vortices.
Figure 2:
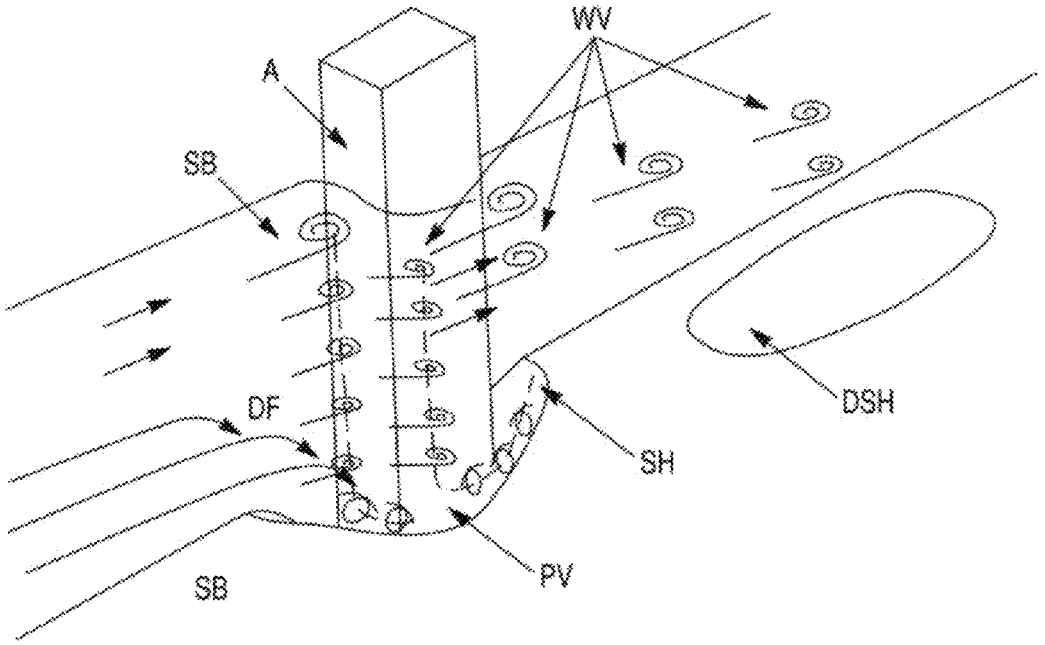
Fig. 2 Prior Art
Figure 3:
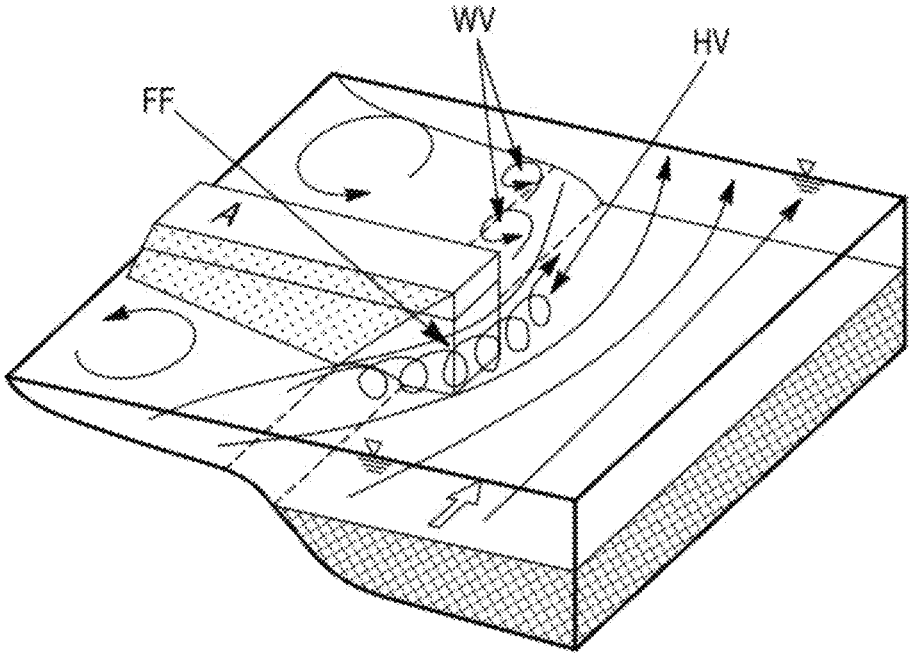
Fig. 3 Prior Art
Figure 4:
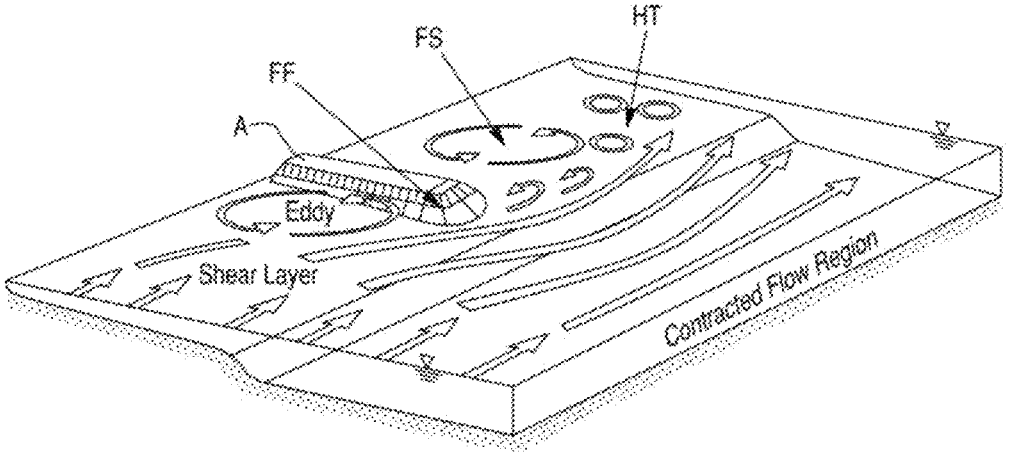
Fig. 4 Prior Art
Figure 5:
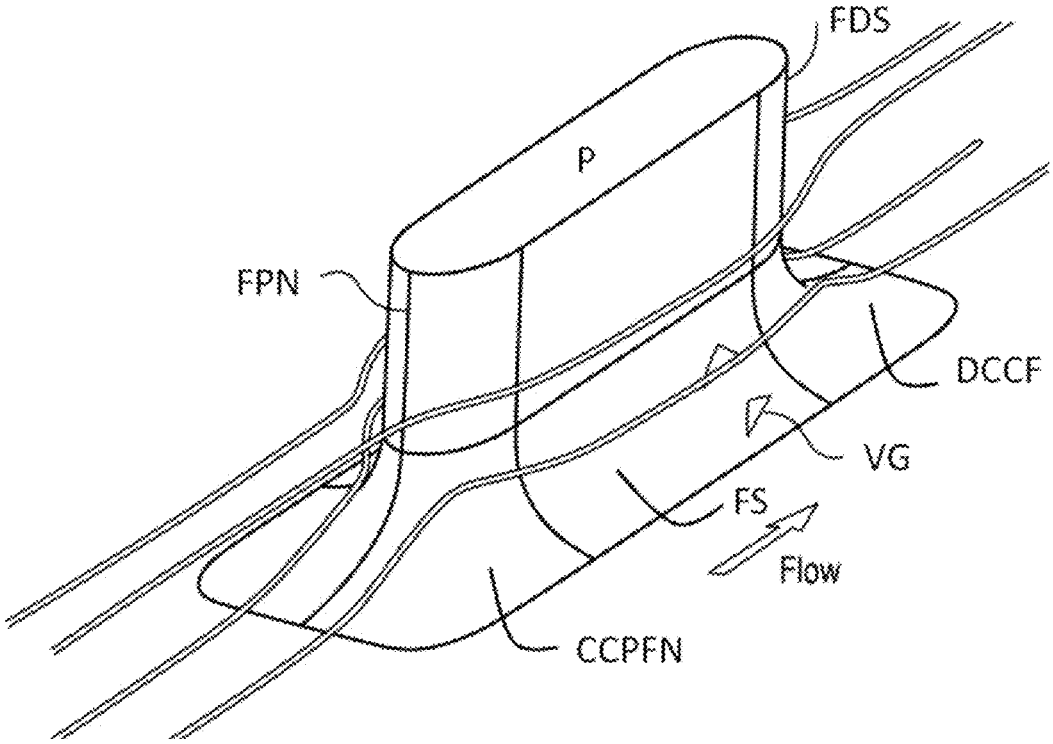
FIG. 5 shows the continuous surface fairing (Simpson et al. prior art) at the bottom of a bridge pier with calculated flow streamline patterns.
Figure 6:
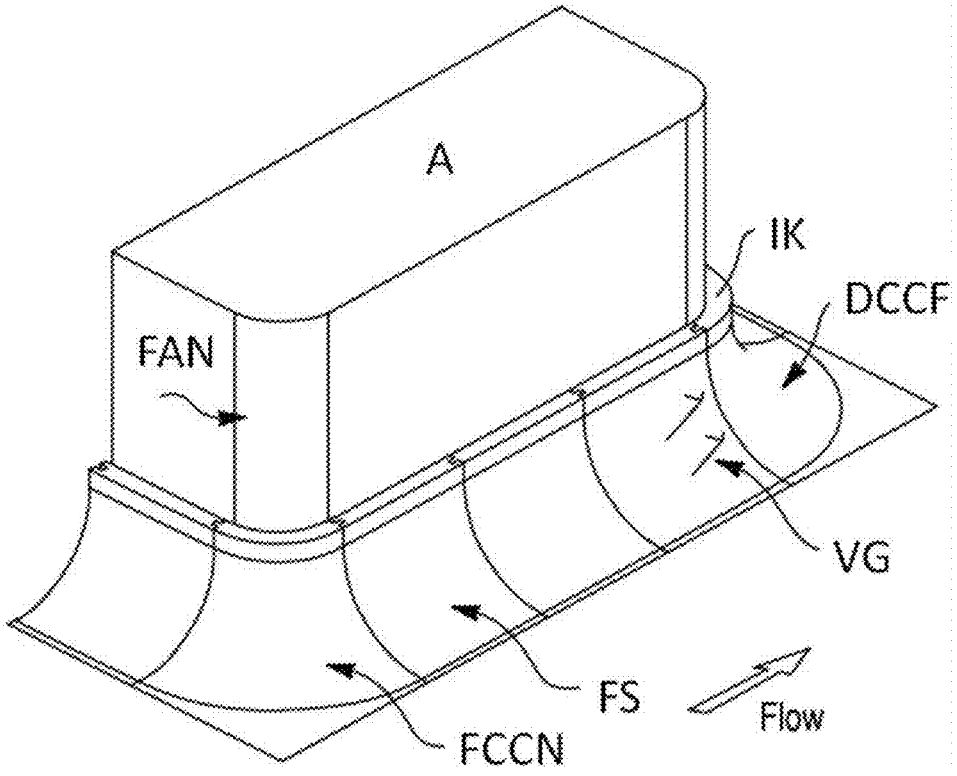
Fig. 6 Prior Art
FIG. 6 shows a continuously varying slope and curvature surface fairing (Simpson et al. prior art) and its components for a vortex preventing design for the bottom of a bridge abutment.
Figure 7:
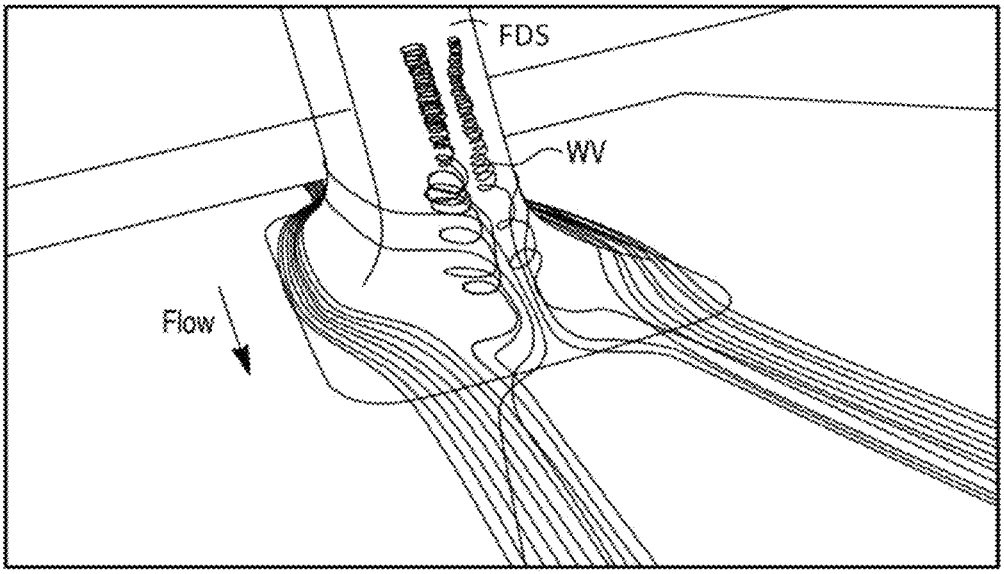
Fig.7 Prior Art
FIG. 7 shows the wall flow pattern from computational fluid dynamics (CFD) simulations at the downstream end of the continuously varying slope and curvature surface fairing (Simpson et al. prior art) for the approach flow aligned with the pier centerline or the straight-ahead case.

Because bridge piers and abutments are the most common hydraulic structures, in the following description bridge piers and abutments are used as examples. The local vortex preventing scour countermeasure devices and methods described herein may be extended to other like hydraulic substructures. The present invention relates to fairings, preferably together with a vortex generator (VG), for preventing scour in the vicinity of a hydraulic structure. The fairing contains a piece wise continuously varying slope and concave-convex curvature surface. The piecewise continuously varying slope and curvature surface is made of a plurality of smaller surfaces that are assembled to form the piecewise continuously varying slope and curvature surface. Each of the plurality of smaller surfaces itself is a continuous surface. When the smaller surfaces are assembled to form the fairing surface, discontinuities in slope and curvature occur at their intersection, thus giving rise to the piecewise continuously varying slope and curvature fairing surface. The piecewise continuously varying slope and curvature fairing is generally composed of a nose section, side sections, and stern section. The nose section is the upstream most section; the stern section is the downstream most section, and the side sections connect the nose and stern sections on either side of the hydraulic structure.

The piecewise continuously varying slope and convex-concave fairing may be formed on the hydraulic structure as a retrofit or a new construction. A retrofit is a surface that is added on to an existing hydraulic structure to reduce scouring. A new construction is a surface that is constructed as part of the original hydraulic structure. The fairing surface may be formed from various materials, such as concrete, steel, sheet metal, fiberglass, etc. For a retrofit, individual smaller surfaces may be formed, e.g., by casting or molding, and transported to and assembled on the hydraulic structure. Here, the individual smaller surfaces may be premanufactured and interlock using matching keys or alignment surfaces among individual premanufactured elements. For new construction, the hydraulic structure is designed with the piecewise continuously varying slope and curvature fairing and constructed along with the hydraulic structure. In new construction, the piecewise design allows the mold to be built in smaller sections for easy transport to and assembly at the construction site. The fairing surface may be constructed of cast-in-place concrete, pre-cast concrete, sprayed concrete, metal, composite, fiber reinforced polymers, or combinations thereof.

Figure 24:
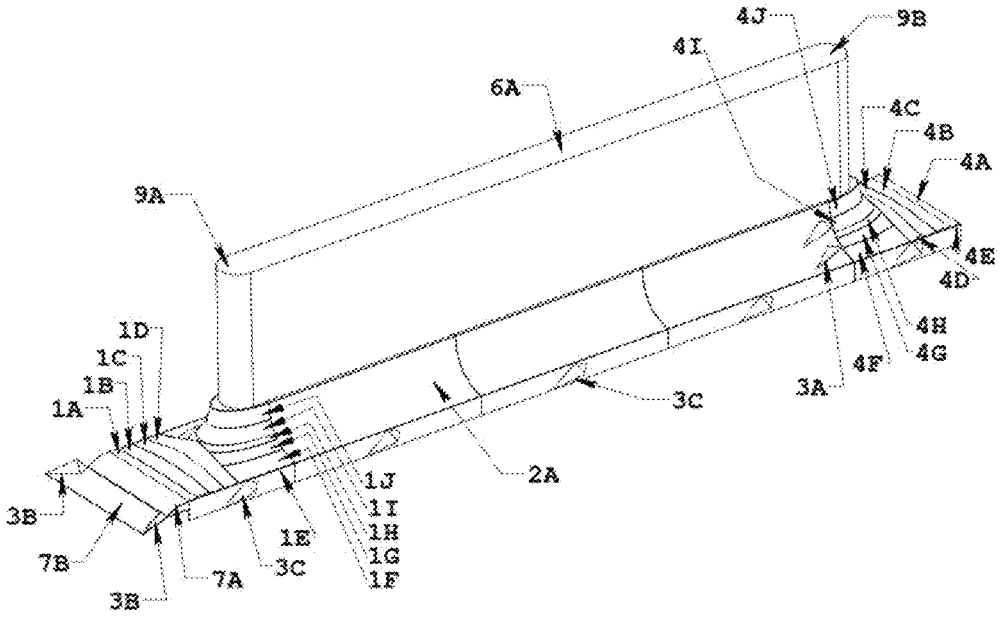
FIG. 24 is a drawing of a full-scale sheet metal retrofit fairing with VGs for a pier (6A) with a piece-wise continuously varying slope and concave-convex curvature surface, with individual sections or pieces of nose surface (1A), (1B), (1C), (1D), (1E), (1F), (1G), (1H), (1I), and (1J); for the side of the pier (2A); and the stern or tail, with individual sections or pieces of surface (4A), (4B), (4C), (4D), (4E), (4F), (4G), (4H), (4I), and (4J), within definable tolerances that produce the same effects as a continuously varying slope and concave-convex-curvature surface. The leading edge ramp (7A) and pier foundation protecting VGs (3B) mounted on leading edge plate (7B) and (3C) mounted on (1E) and (2A) protect the foundation from open-bed scour.
Figure 28:
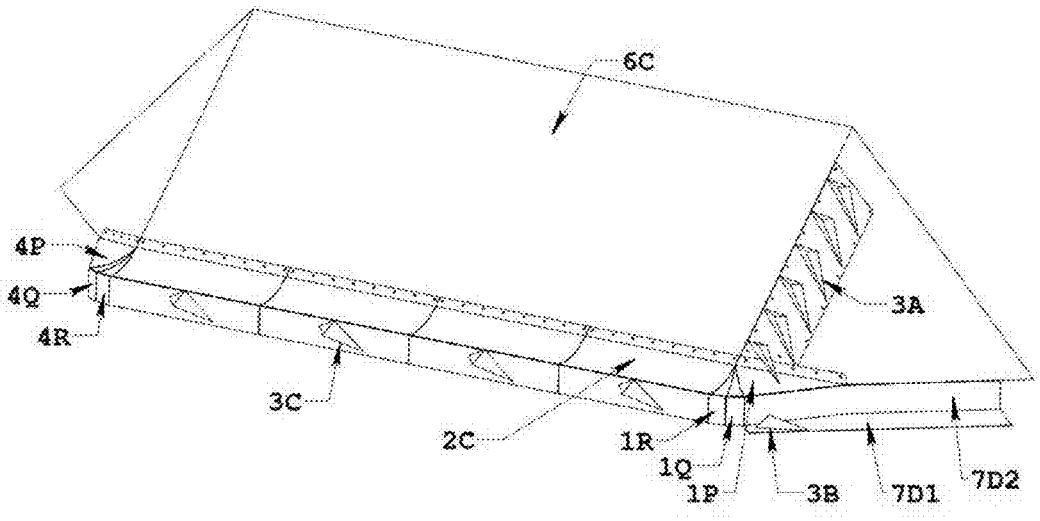
FIG. 28 is a drawing of a full-scale sheet metal retrofit fairing with VGs for a spill-through abutment (6C) with piece-wise continuously varying slope and concave-convex curvature surfaces consisting of individual sections or pieces of surface (1P), (1Q), (1R), (2C), (4P), (4Q), and (4R) within definable tolerances that produce the same effects as a continuously varying slope and concave-convex-curvature surface. VGs (3A) reduce the flow separation and free-surface vortex effects while VG (3B) mounted on leading edge horizontal plate (7D1) connected to vertical plate (7D2) and VG (3C) protect the foundation from open-bed scour.
Figure 29:
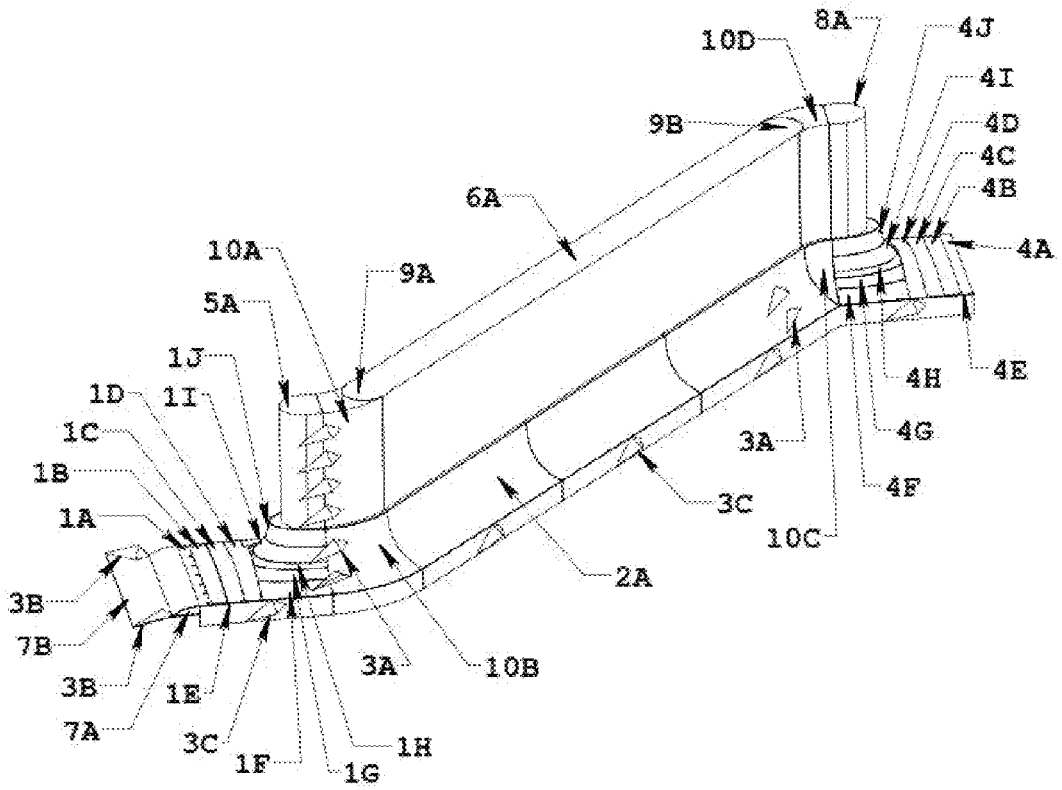
FIG. 29 is a drawing of a full-scale sheet metal retrofit fairing with VGs for a dogleg pier, which consists of a main pier (6A) with curved nose (9A), curved stern (9B), and piece-wise continuous surfaces (5A), (8A), (10A), and (10D). The piece-wise continuously varying slope and concave-convex curvature surfaces for the fairing nose, consisting of individual sections or pieces of surface (1A), (1B), (1C), (1D), (1E), (1F), (1G), (1H), (1I), and (1J); for the side of the pier (2A), (10B), and (10C); and the tail with individual sections or pieces of surface (4A), (4B), (4C), (4D), (4E), (4F), (4G), (4H), (4I), and (4J) within definable tolerances that produce the same effects as a continuously varying slope and concave-convex-curvature surface. Leading edge ramp (7A) and pier foundation protecting VGs (3B) mounted on leading edge plate (7B) and (3C) mounted on (1E) and (2A) protect the foundation from open-bed scour.
Figure 30:
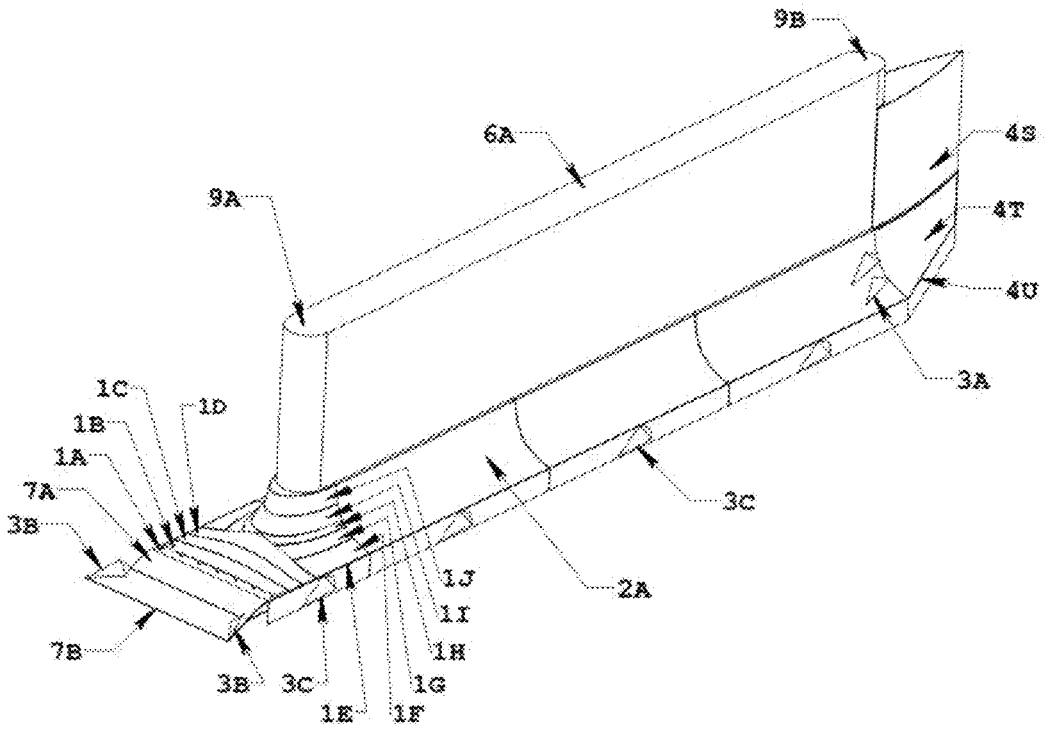
FIG. 30 is a drawing of a full-scale sheet metal retrofit fairing with VGs for a pier with a piece-wise continuously varying slope and curvature tail or stern. The pier consists of a main pier (6A) with curved pier nose (9A) and curved pier stern (9B). Piece-wise continuously varying slope and concave-convex curvature surface for the fairing nose, containing individual sections or pieces of surface (1A), (1B), (1C), (1D), (1E), (1F), (1G), (1H), (1I), and (1J); for the side of the pier (2A); and the tail, with individual sections or pieces of surface (4S), (4T), and (4U), within definable tolerances that produce the same effects as a continuously varying slope and concave-convex-curvature surface. The leading edge ramp (7A) and pier foundation protecting VGs (3B) mounted on leading edge plate (7B) and (3C) mounted on (1E) and (2A) protect the foundation from open-bed scour.
Figure 31:
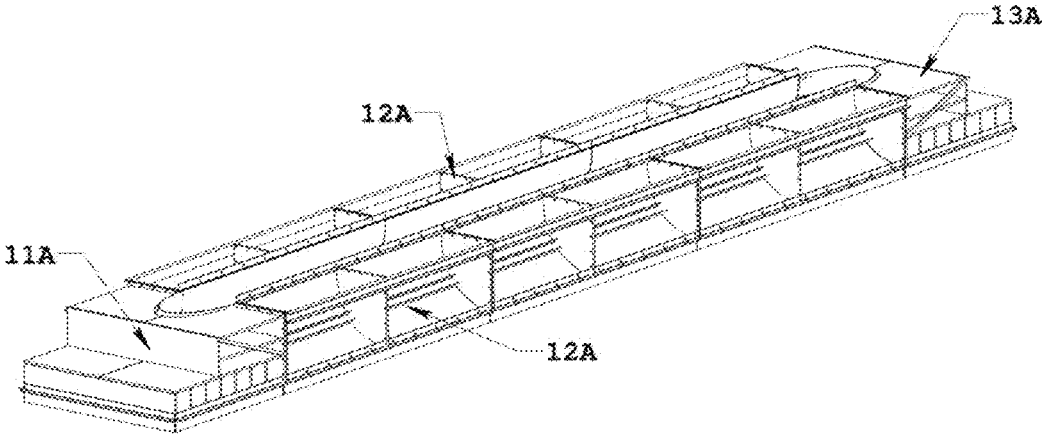
FIG. 31 is a perspective top view drawing of concrete forms for the piece-wise continuously varying slope and curvature fairing during construction of a new pier: (11A) for the nose, (12A) for the sides, and (13A) for the stern.
Figure 33:
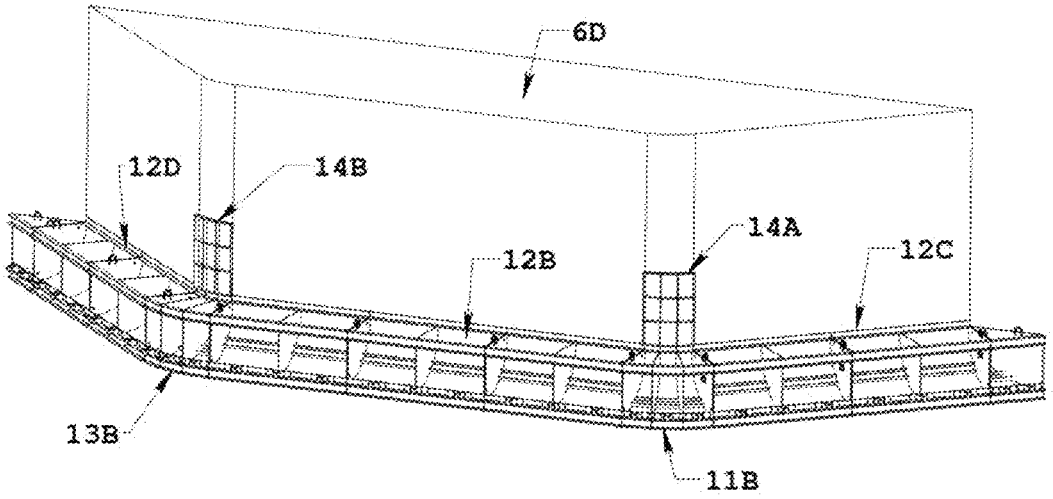
FIG. 33 is a perspective view drawing of concrete forms for the piece-wise continuously varying slope and curvature fairing during construction of a new wing-wall abutment (6D): (12C) for the nose, (11B) for the upstream bend, (12B) for the sides, (13B) for the downstream bend, (12D) for the stern, (14A) for the upstream corner fairing, and (14B) for the downstream corner fairing.
Figure 34:
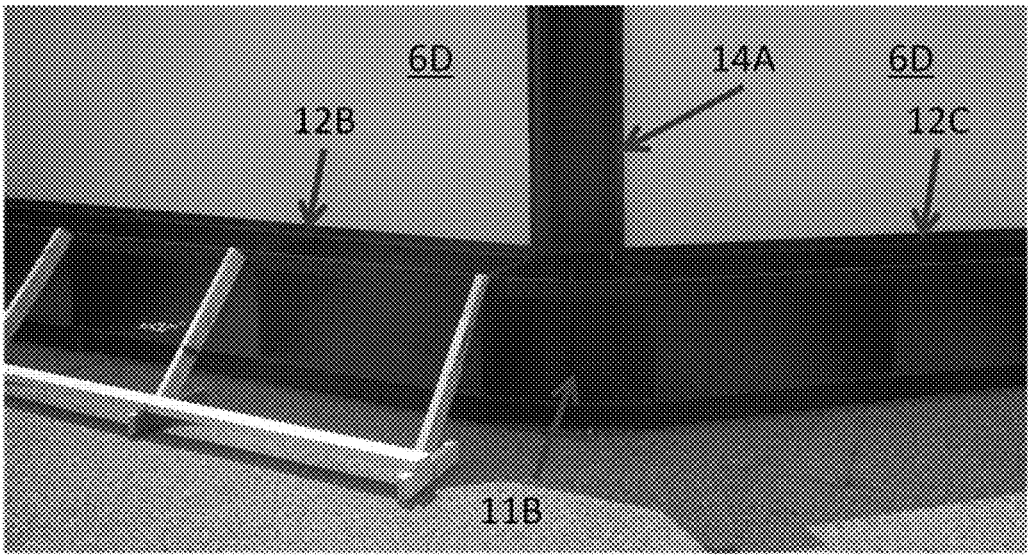
FIG. 34 shows an example of steel concrete forms (11B), (12B), (12C), and (14A) for the piece-wise continuously varying slope and curvature fairing for construction of a new wing-wall abutment (6D).
Figure 36:
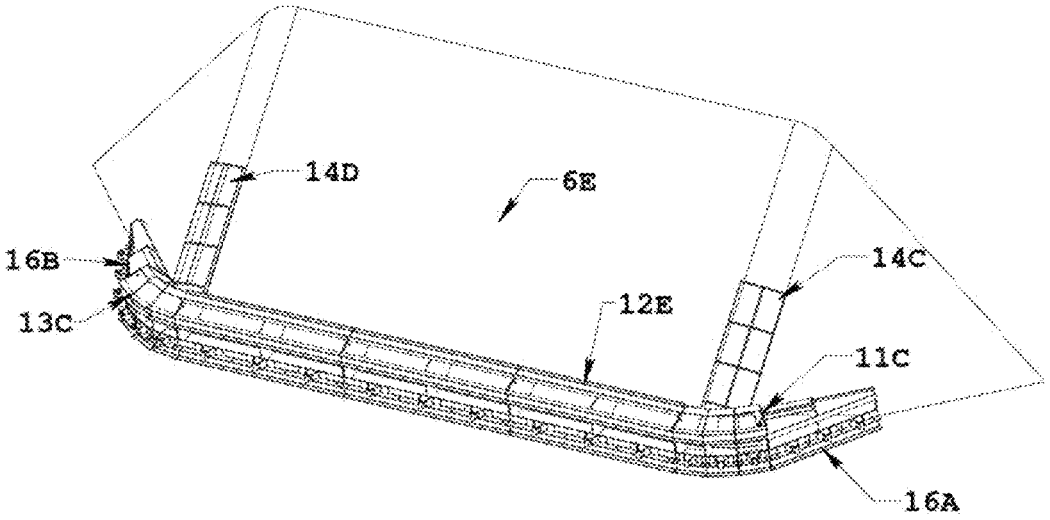
FIG. 36 is a perspective view drawing of steel concrete forms for the piece-wise continuously varying slope and curvature fairing during construction of a new spill-through abutment (6E): (16A) for the nose, (11C) for the upstream bend, (12E) for the sides, (13C) for the stern bend, (16B) for the stern, (14C) for the upstream corner fairing, and (14D) for the downstream corner fairing.
Figure 37:
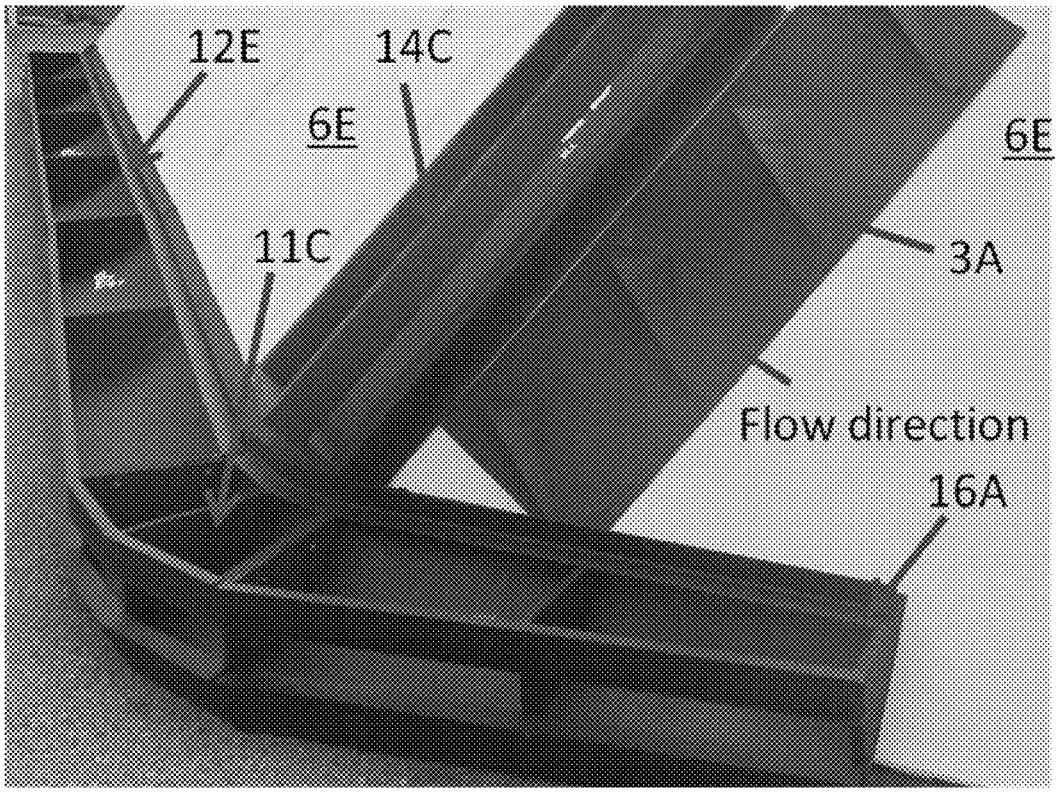
FIG. 37 shows an example of steel concrete forms (16A), (11C), (12E), and (14C) for the piece-wise continuously varying slope and curvature fairing for construction of a new spill-through abutment (6E). VGs (3A) are shown mounted on the abutment for flow separation and surface vortex control.
Figure 38:
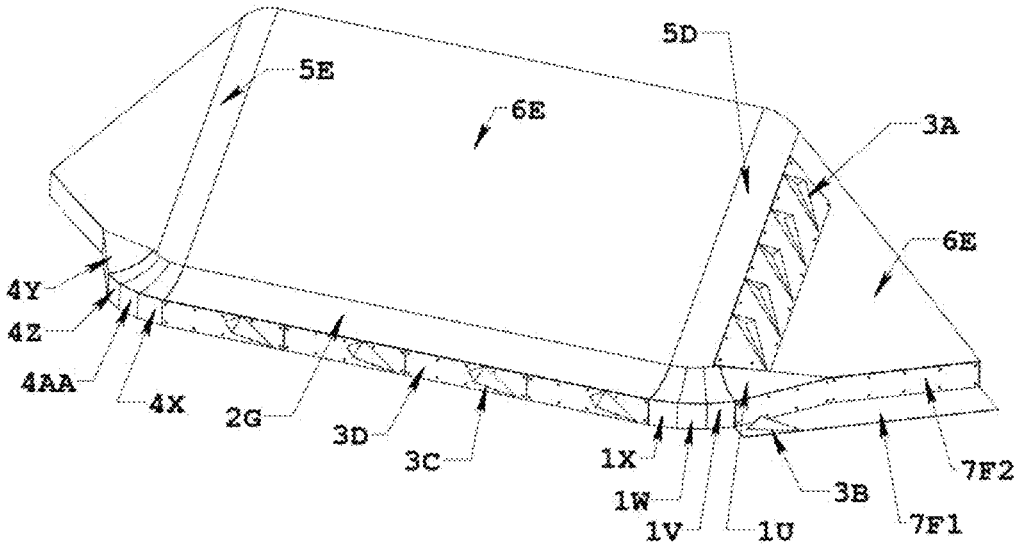
FIG. 38 is a drawing of a finished new construction spill-through abutment (6E) with the piece-wise continuously varying slope and curvature concrete fairing containing continuously varying slope and curvature pieces (1U), (1V), (1W), (1X), (2G), (4U), (4V), (4W), (4X), (5D) and (5E). VGs (3A) are mounted on the abutment for flow separation and surface vortex control while VG (3B) mounted on leading edge horizontal plate (7F1) connected to vertical plate (7F2) and VG (3C) protect the foundation from open-bed scour.

Referring to the drawings, especially FIGS. 24, 26, 28, 29, 30, 35, and 38, which show global views of several embodiments of the present piecewise continuously varying slope and curvature fairing surface. The components of the piecewise continuously varying slope and curvature fairing surface include one or more of the following:

a. Smaller continuously varying slope and curvature surfaces (1A) to (1X) are assembled together to form the nose section of the piecewise continuously varying slope and curvature fairing. As illustrated in FIG. 24, each of the individual smaller continuously varying slope and curvature surfaces (1A), (1B), (1C), (1D), (1E), (1F), (1G), (1H), (1I), (1J) individually has curvature in one direction at one location on each surface and intersect adjacent pieces to form the piecewise continuously varying slope and concave-convex-curvature surface of the nose section (FIGS. 24, 29, an 30). Smaller continuously varying slope and curvature surfaces (1L), (1M), (1N), and (1O) apply to a retrofit to a wing-wall abutment (FIG. 26) while (1P), (1Q), and (1R) apply to a retrofit to a spill-through abutment (FIG. 28). New concrete finished surfaces (1T) and (1U), (1V), (1W), and (1X) apply to new wing-wall (FIG. 35) and spill-through abutments (FIG. 38), respectively.

b. Smaller continuously varying slope and curvature surfaces (2A) through (2G) form the side section(s) of the piecewise continuously varying slope and curvature fairing.

c. (3A) through (3C) are specially designed vortex generators with (3A) being a vortex generator assembly, (3B) being a leading edge vortex generator, and (3C) being a foundation vortex generator.

d. Smaller continuously varying slope and curvature surfaces (4A) through (4AA) form the stern section of the piecewise continuously varying slope and curvature fairing. As illustrated in FIG. 24, each of the individual smaller continuously varying slope and curvature surfaces (4A), (4B), (4C), (4D), (4E), (4F), (4G), (4H), (4I), (4J) individually has curvature in one direction at one location on each surface and intersect adjacent pieces or sections to form the piecewise continuously varying slope and concave-convex-curvature surface of the stern section (FIGS. 24 and 29). Sections (4M), (4N), and (4O) apply to a retrofit to a wing-wall abutment (FIG. 26), while (4P), (4Q), and (4R) apply to a retrofit to a spill-through abutment (FIG. 28). Sections (4S), (4T), and (4U) apply to a faired tail assembly (FIG. 30). New concrete finished surfaces (4T) and (4X), (4Y), (4Z), and (4AA) apply to new wing-wall (FIG. 35) and spill-through abutments (FIG. 38), respectively.

e. (5A) through (5D) are a faired or curved cylindrical pier or abutment surface. Here, (5A) is a pier nose in a dogleg retrofit (FIG. 29). Sections (5B) and (5C) are curved corners for a new construction wing-wall abutment (FIG. 35), while sections (5D) and (5E) are curved corners for a new construction spill-through abutment (FIG. 38).

f. (6A) through (6E) are existing or new bridge piers or abutments (FIGS. 24, 26, 28, 29, 30, 35, and 38).

g. (7A) is a foundation leading edge ramp (FIGS. 24, 29, and 30). The ramp (7A) is positioned to prevent the formation of a horseshoe vortex that would scour the sides of the foundation.

h. (7B) through (7F2) are upstream leading edge horizontal and vertical plates on which leading edge vortex generators (3B) are mounted. (7B) is a horizontal plate used on a pier nose (leading edge plate) (FIGS. 24, 29, and 30). The leading edge plate 7B is positioned so that the VGs (3B) can be located upstream of the side edge of the leading edge ramp (7A). (7C1), (7D1), (7E1), and (7F1) are upstream leading edge horizontal plates for abutments (FIGS. 26, 28, 35, 38). (7C2), (7D2), (7E2), and (7F2) are vertical plates mounted to abutment foundations on which the horizontal plates are attached (FIGS. 26, 28, 35, 38).

i. (8A) is a cylindrical pier downstream surface (FIG. 29).

j. (9A) and (9B) are existing cylindrical pier nose (9A) or stern (9B) (FIGS. 24 and 30).

k. (10A), (10B), (10C) and (10D) are continuously varying slope and curved pier nose or tail extensions (FIG. 29). These nose or tail extensions are added to the pier (6A) to provide a piece-wise continuously varying slope and curvature surface to the s-shape of the final structure.

l. (11A), (11B), and (11C) are molds for new construction piece-wise continuously varying slope and curvature three-dimensional convex-concave pier or abutment hydraulic structure nose or leading edge fairing (FIGS. 31-34 and 36-37).

m. (12A), (12B), (12C), (12D), and (12E) are molds for new construction piece-wise continuously varying slope and curvature cylindrical curved side fairings for piers or abutments (FIGS. 31-34 and 36-37).

n. (13A), (13B), and (13C) are molds for new construction piece-wise continuously varying slope and curvature three-dimensional convex-concave pier or abutment hydraulic structure stern or downstream fairing (FIGS. 31, 33, and 36).

o. (14A), (14B), (14C), and (14D) are molds for new construction piece-wise continuously varying slope and curvature three-dimensional convex-concave abutment hydraulic structure corner fairing (FIGS. 33-34 and 36-37).

p. (16A) and (16B) are molds for new construction piece-wise continuously varying slope and curvature leading edge and trailing edge fairings for abutment hydraulic structures (FIG. 36).

The VGs (3A, 3B, or 3C) used here are each a tetrahedron-a polyhedron composed of four triangular faces, three of which meet at each vertex. This shape is chosen specifically because it acts to deter build-up of debris that is present in flood conditions. The tetrahedron design of Simpson et al. (U.S. Patent Application Publication No. 2011/0315248 which is incorporated herein by reference) may be appropriate for the present invention. Other kinds of vortex generators used to control boundary layer separation are described, e.g., by Wheeler (U.S. Pat. No. 5,058,837, which is incorporated herein by reference may also be used in the present invention, but may snag debris, whereas the Simpson et al. VGs will not. The VGs may be constructed of cast-in-place concrete, pre-cast concrete, sprayed concrete, metal, composite, fiber reinforced polymers, or combinations thereof. VGs are always positioned in regions of zero or negative streamwise pressure gradients in order to create a stream-wise vortex. The VGs are placed at locations where: (1) they can be effective in creating stream-wise vortices that bring higher velocity fluid toward the surface wall, e.g. VGs 3A; or (2) they can be effective to create stream-wise vortices that bring river bed materials close to the foundation, e.g. VGs (3B and 3C). The VGs (3A) are located at least one vortex generator length upstream of where the stream-wise pressure gradients become positive.

The spacing between them must be great enough that they allow the vortex on an adjacent VG to form, generally at least ½ of a VG length. They cause higher velocity fluid to move toward the wall and mix and energize the near-wall fluid. This more energetic fluid will move further along a streamlined surface than otherwise, thus producing a smaller less energetic and scouring downstream separation vortex. This reduced rear or stern separation has lower downstream velocities and much less downstream scour. The VG (3B) is initially buried under the surrounding river bed material in front of the pier nose. Under intense scouring conditions, such as during floods or other high-flow-speed events, this river bed material in front of the nose of the pier is scoured away, revealing the VGs (3B). Each VG (3B) then generates a stream-wise vortex that pulls river-bed material toward the foundation of the pier, thereby protecting the foundation from further scour. Likewise, the VG 3C is initially buried under the surrounding river bed material and mounted on the side of the nose (1E). Under intense scouring conditions, such as during floods or other high-flow-speed events, this river bed material on the side of the nose of the pier is scoured away, revealing the 3C VG. The 3C vortex generator then generates a stream-wise vortex that pulls river-bed material toward the foundation of the pier, thereby protecting the foundation from further scour. The VG (3C) is located at least 2 VG lengths downstream of VG (3B).

As best shown in FIGS. 24-38, the exemplary embodiments are drawn to pier structures (FIGS. 24-25, 29-32) and abutments structures (FIGS. 26-28 and 33-38). The exemplary pier may be a straight pier (FIGS. 24-25 and 30-32) or dogleg pier (FIG. 29). The straight pier may have a stern section that is a mirror image of the nose section (FIG. 24). In that embodiment, the piecewise continuously varying slope and curvature nose and stern section may be made of similarly shaped smaller continuously varying slope and curvature surfaces. Here, smaller continuously varying slope and curvature surfaces (1A) and (4A) are similar, (1B) and (4B) are similar, (1C) and (4C) are similar, etc. Preferably, however, the upstream end of the nose section contains a ramp (7A) attached to upstream surface (1A), more preferably with vortex generators (3B) attached to the upstream corners of the ramp (7A). No ramp is needed down stream of stern section.

Figure 23:
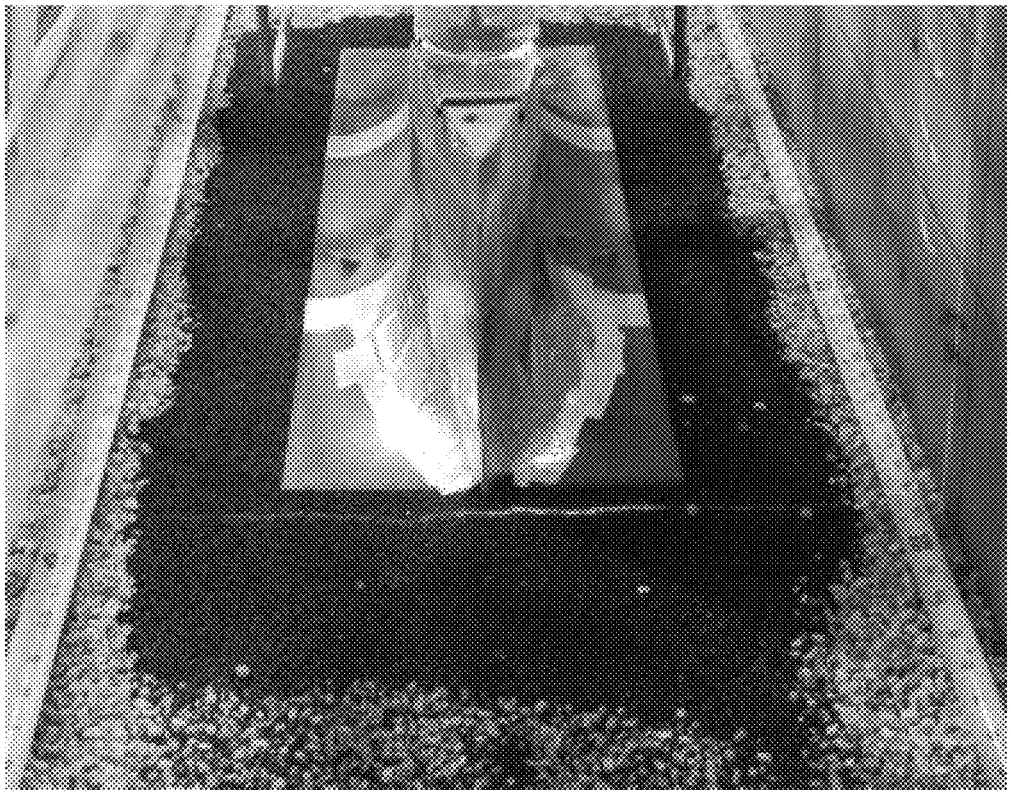
FIG. 23 shows much lower scour around the fairing with VGs model with the tail for the same flume run time as in FIG. 22.

In an alternative embodiment, as illustrated in FIG. 30, the stern section contains a tapered shape rather than a rounded shape of the nose section. This tapered shape is formed by smaller continuously varying slope and curvature surfaces (4S), (4T), and (4U). The tapered stern reduces the stream-wise positive pressure gradient and reduces the possibility of a massive separation that will result in scour downstream. In a narrow surrounding channel, as shown in FIG. 23, without the tapered stern there would be greater stream-wise positive pressure gradients than if there was no narrow channel, with greater separation and scour. Also with the tapered stern, a smaller continuously varying slope and curvature surface (4S) rises to a height higher than the nose and side sections of the piecewise continuously varying slope and curvature fairing. The smaller continuously varying slope and curvature surface (4S) does not need to be as high as the pier (6A); it just needs to be high enough to keep the flow downstream of the stern (9B) in FIG. 30 from coming down to the river bed. The smaller continuously varying slope and curvature surfaces (4T and 4U) are also positioned to produce lower positive pressure gradients, weaker separations, and less scour.

In another embodiment, as illustrated in FIG. 29, the pier may be retrofitted to contain a dogleg shape. For piers that have a large angle of incidence to the on-coming river flow, there are separations at the nose and the stern of the pier with huge scouring vortices. The nose (5A) of the dogleg is aligned with the on-coming flow direction to prepare the flow to encounter the vortex generators (3A) shown in FIG. 29. With the dogleg pier, the nose and stern sections are constructed similarly as for the straight pier discussed above. However, to form the dogleg, pier nose sections (10A) and (10B) and pier stern sections (10C) and (10D) are also added. The pier nose section (10A) is added to the nose of the pier (6A); and the pier nose section (10B) are added between the side section (2A) and the smaller continuously varying slope and curvature surfaces (1F), (1G), (1H), (1I), (1J). In addition, a front pier nose section (5A) is also added in front of the pier nose section (10A). The stern section is also formed symmetrical to the nose section. In a preferred embodiment, the dogleg pier also contains a ramp (7A) attached to upstream surface (1A), more preferably with vortex generators (3B) attached to the upstream corners of the ramp (7A). The VGs energize the flow so that when it moves around to the original side of the pier it will have less separation. A similar VG arrangement would be located on the opposite (hidden and unseen in FIG. 29) wall, just upstream about one VG length from the end of the stern (9B).

Figure 26:
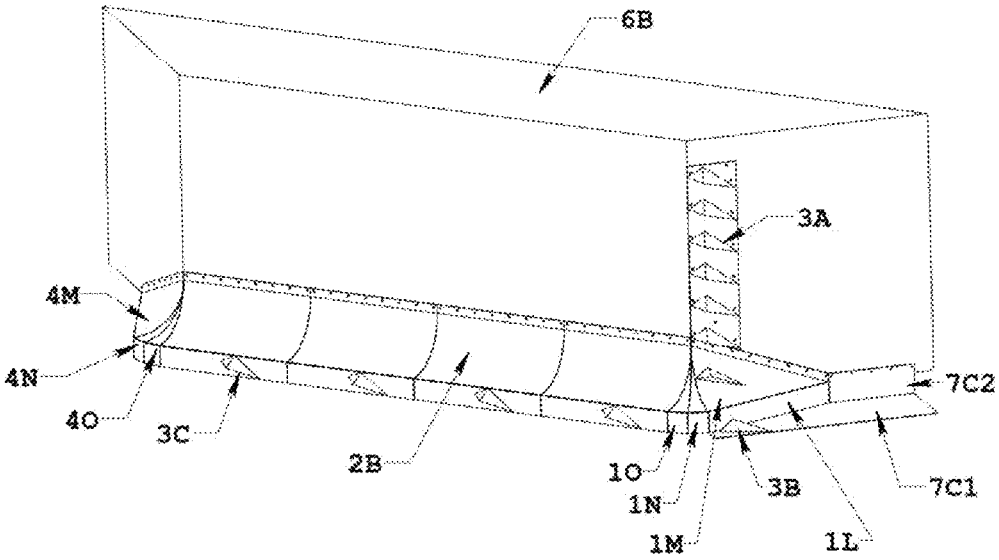
FIG. 26 is a drawing of a full-scale sheet metal retrofit fairing with VGs for a wing-wall abutment (6B) with piece-wise continuously varying slope and concave-convex curvature surfaces consisting of individual sections or pieces of surface (1L), (1M), (1N), (1O), (2B), (4M), (4N), and (4O) within definable tolerances that produce the same effects as a continuously varying slope and concave-convex-curvature surface. VG (3A) reduce the flow separation and free-surface vortex effects while VG (3B) on leading edge horizontal plate (7C1) that is connected to vertical plate (7C2) and VG (3C) protect the foundation from open-bed scour.
Figure 27:
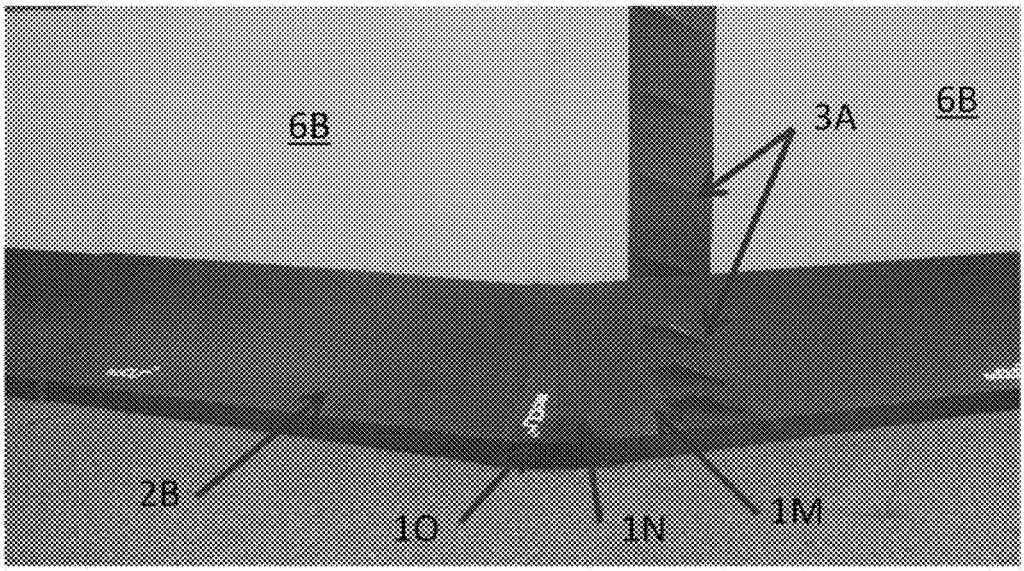
FIG. 27 shows an example of a stainless steel piece-wise continuously varying slope and curvature surface retrofit fairing for a wing-wall abutment consisting of individual sections or pieces of surface (1M), (1N), (1O), and (2B) within definable tolerances that produce the same effects as a continuously varying slope and concave-convex-curvature surface. VGs (3A) reduce the flow separation and free-surface vortex effects.
Figure 35:
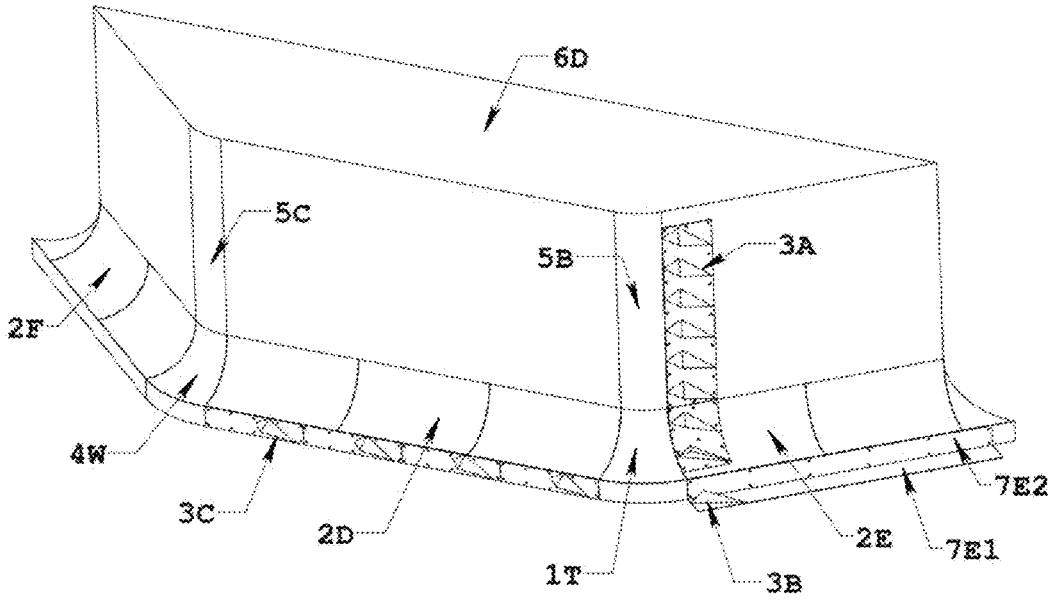
FIG. 35 is a drawing of a finished new construction wing-wall abutment (6D) with the piece-wise continuously varying slope and curvature concrete fairing containing continuously varying slope and curvature pieces (1T), (2D), (2E), (2F), (4W), (5B), and (5C). VGs (3A) reduce the flow separation and free-surface vortex effects while VG (3B) mounted on leading edge horizontal plate (7E1) connected to vertical plate (7E2) and VG (3C) protect the foundation from open-bed scour.

The exemplary abutments may be a wing-wall abutment (FIGS. 26-27 and 33-35) or a spill-through abutment (FIGS. 28 and 36-38). As best illustrated in FIGS. 26 and 35, the piecewise continuously varying slope and curvature fairing surface for the wing-wall abutment includes smaller continuously varying slope and curvature surfaces (1L), (1M), (1N), (1O) forming the leading edge of the fairing; side section surfaces (2B); and smaller continuously varying slope and curvature surfaces (4M), (4N), (4O) forming the trailing edge of the fairing. A leading edge horizontal plate (7C1) and a vertical plates (7C2) may be mounted to the abutment foundations upstream of the piecewise continuously varying slope and curvature fairing, preferably for mounting of the leading edge VG (3B).

As best illustrated in FIGS. 28 and 38, the piecewise continuously varying slope and curvature fairing surface for the spill-through abutment includes smaller continuously varying slope and curvature surfaces (1P), (1Q), (1R) forming the leading edge of the fairing; side section surfaces (2C); and smaller continuously varying slope and curvature surfaces (4P), (4Q), (4R) forming the trailing edge of the fairing. A leading edge horizontal plate (7D1) and a vertical plates (7D2) may be mounted to the abutment foundations upstream of the piecewise continuously varying sloe and curvature fairing, preferably for mounting of the leading edge VG (3B).

As mentioned above the piecewise continuously varying slope and curvature fairing surface may be retrofitted on to an existing hydraulic structure or be a new construction. As a retrofit, the individual smaller continuously varying slope and curvature surfaces may be formed, e.g. by stamped sheet metals, and attached to the hydraulic structure using fasteners, such as screws, rivets, anchors, etc. Once installed, the individual smaller continuously varying slope and curvature surfaces cooperate to form the piecewise continuously varying slope and curvature fairing surface.

Figure 32:
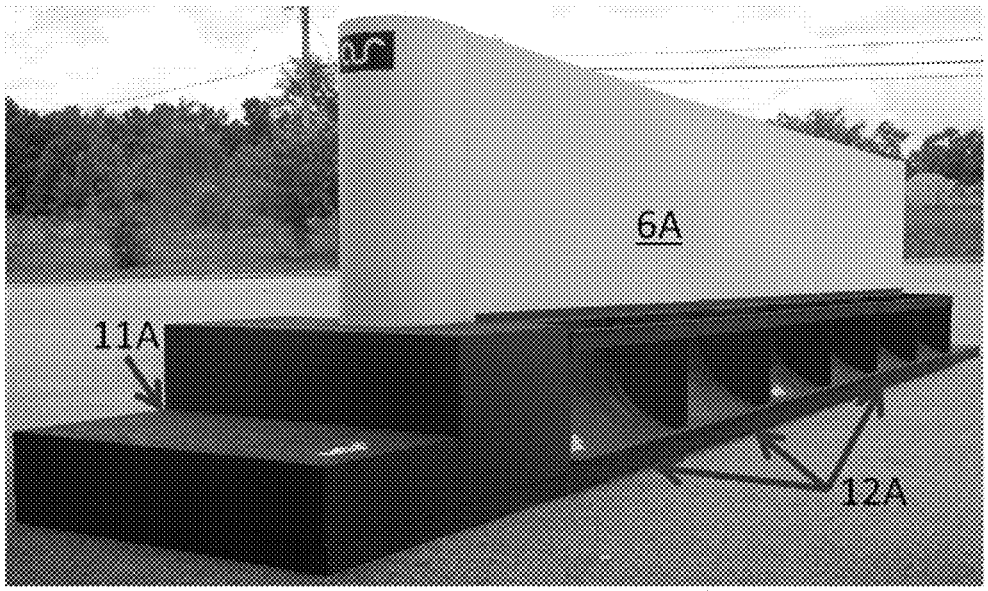
FIG. 32 shows an example of steel forms 11A and 12A for the piece-wise continuously varying slope and curvature fairing for construction of a new concrete pier 6A.

For a new construction, a mold is generally built around the hydraulic structure and concrete is poured into the mold to form the piecewise continuously varying slope and curvature fairing surface. Exemplary molds are shown in FIGS. 31-32 for a straight pier, FIGS. 33-34 for a wing-wall abutment, and FIGS. 36, 37 for a spill-through abutment.

Without further description, it is believed that one of ordinary skill in the art can, using the preceding description and the following illustrative examples, make and utilize the devices and practice the methods of the present disclosure. The following examples re given to illustrate the present disclosure. It should be understood that the disclosure is not to be limited to the specific conditions or details described in the examples.

Figure 8:
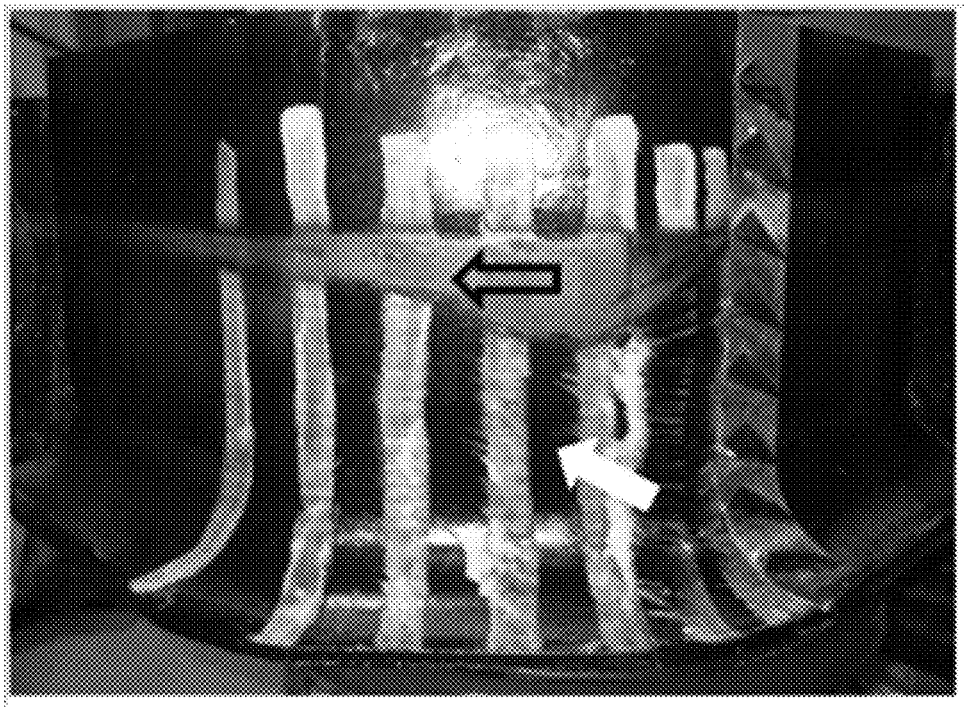
FIG. 8 shows surface oil flow results for the modified wing-wall abutment model with vortex generators (VGs). Flow is from right to left. The upward streaks show that the fairing and vortex generator cause the flow to move up the wing-wall abutment. The gray region is produced by a mixture of the oil flow material and waterborne substances at the free surface.

Examples of Scour-Vortex-Preventing Fairing and Vortex Generator Concepts for Wing-Wall and Spill-Through Abutments Applications to more types of abutments than shown by the experiments by Simpson et al. are given. In addition to the square-cornered abutments discussed in that patent, scale model tests prove that the piece-wise continuously varying slope and curvature fairing with the help of vortex generators prevent scouring vortices for wing-wall and spill-through abutments. Research by Sheppard et al. (2011) using hundreds of sets of scour data and sponsored by the National Co-operative Highway Research Program (NCHRP) shows that model scale bridge scour experiments produce much more severe scour depth to pier size ratios than the scour depth to pier size ratios observed for full-scale cases due to scale effects. Thus, all of the model scale flume tests presented here show more scour than at full scale (Simpson 2013). As explained below, FIGS. 8-13 show the key results that the fairing and VG products prevent the formation of scouring vortices and scour for wing-wall and spill-through abutments. FIG. 8 shows surface oil flow results for a fairing for a wing-wall abutment with VGs. The mixture of yellow artist oil paint and mineral oil flows with the skin friction lines. Streaks of this mixture are first painted about perpendicular to the flow direction on a black painted surface. The right to left flow causes some oil to be carried downstream in a local flow direction, which can be observed against the black painted surface. FIG. 8 clearly shows that the effects of the fairing and VG products are to bring lower velocity flow up from the flume bottom and prevent the scour around the bottom of the abutment.

Figure 9:
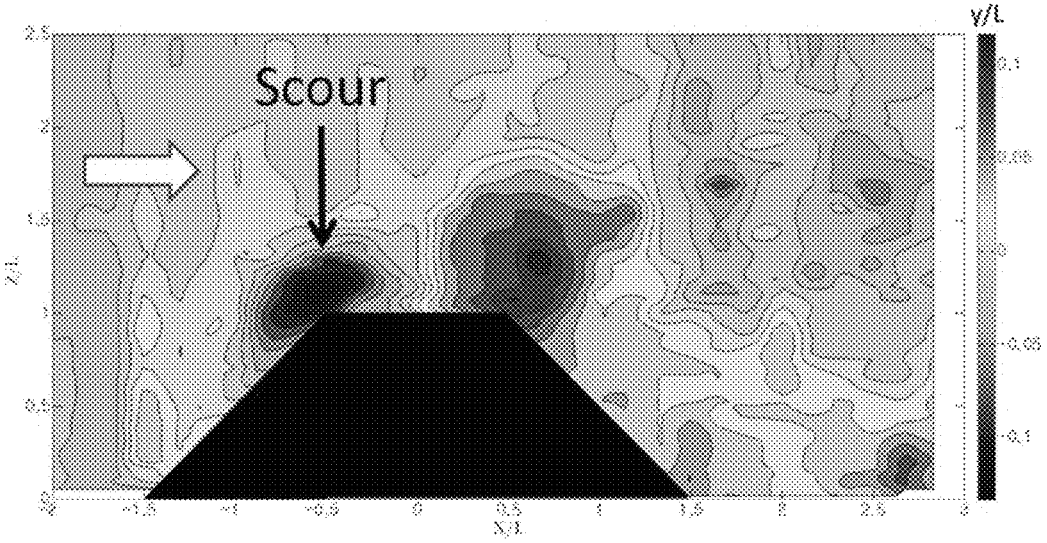
FIG. 9 illustrates the bed level change contours at streamwise X and spanwise Y locations after and before a flow around the wing-wall abutment model with length L into the flow without the fairing and VGs of the present invention.
Figure 10:
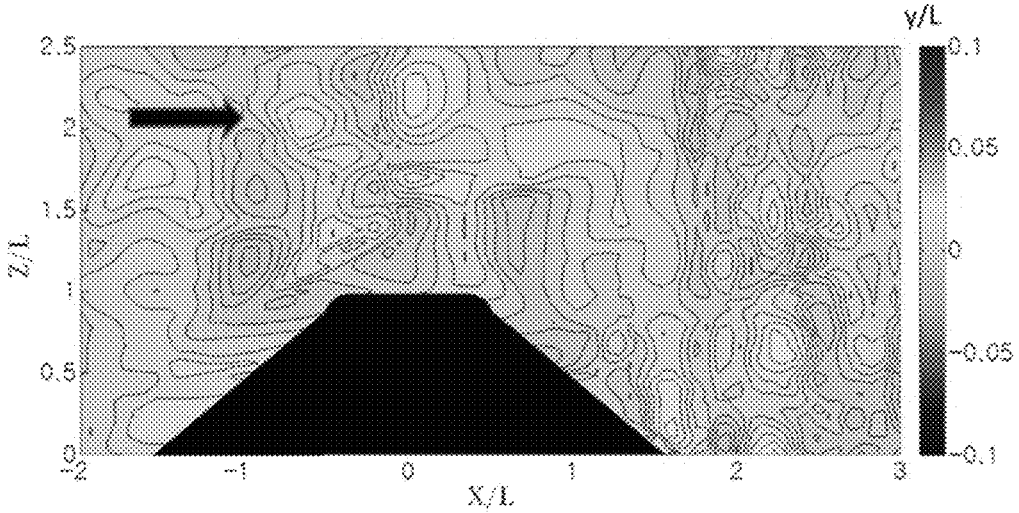
FIG. 10 shows the bed level change contours at streamwise X and spanwise Y locations after and before flow around the fairing protected modified wing-wall model (length L=159 mm) with vortex generators with no scour observed at any location.

FIG. 9 shows the deep scour holes for the same wing-wall abutment without fairing and VG. This figure shows that when there is no scour protection by the use of the piece-wise continuously varying slope and curvature fairing and VGs, there will be considerable scour. Here X is the stream-wise location, Z is the spanwise location, and L is the dimension of the abutment into the flow. With a fairing modified wing-wall abutment with VGs, there is not only no scour around the model base, but there is no open bed scour hole farther downstream of the model around X/L=2 as shown in FIG. 10. This is due to the effect of VGs on the surface vortex which caused the scour hole farther downstream of the model for the untreated case. The VGs generate counter-rotating vortices which diffuse and reduce the strength of the free-surface generated vortex. No scour occurred around the contraction and near the base of the modified wing wall with VGs. No open bed scour was observed.

Some flow and scour depth results are given for a flume test for a faring modified spill-through abutment with VGs. This test has been performed under the same flow conditions and flume geometry as for the spill-through abutment without fairing and VGs.

Figure 11:
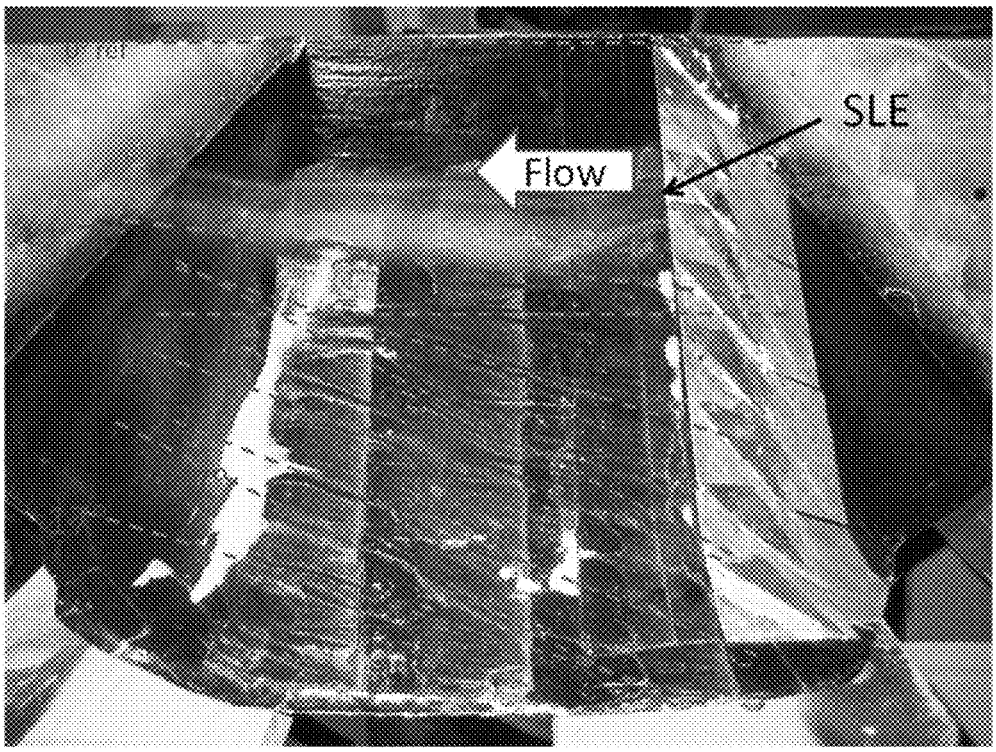
FIG. 11 shows surface oil flow results for a fairing and VGs with modified sharp-leading edge (SLE) spill-through abutment model with 8 upstream VGs. The flow moves up the abutment as it moves downstream, bringing low speed fluid from the bottom of the river and preventing scour. The gray region is produced by a mixture of the oil flow material and waterborne substances at the free surface.
Figure 12:
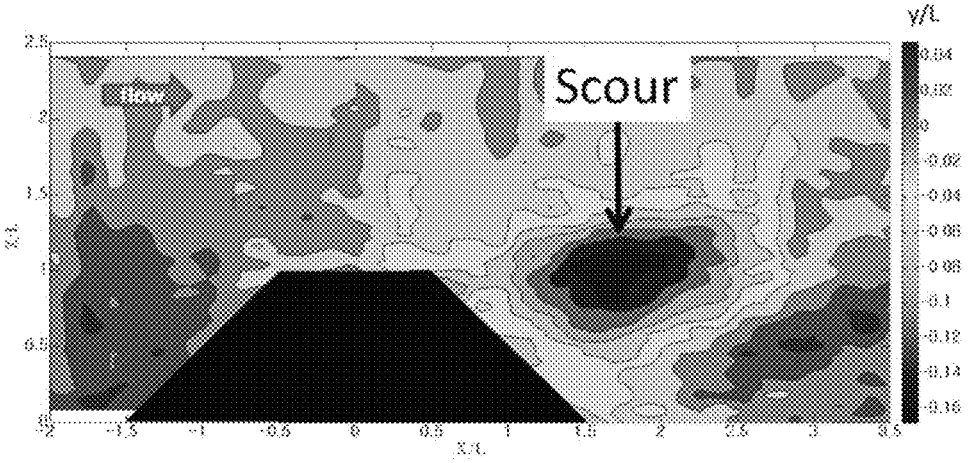
FIG. 12 illustrates bed level change contours at streamwise X and spanwise Y locations after and before flow around the untreated spill-through abutment model (L=159 mm). Note the dark blue scour hole.
Figure 13:
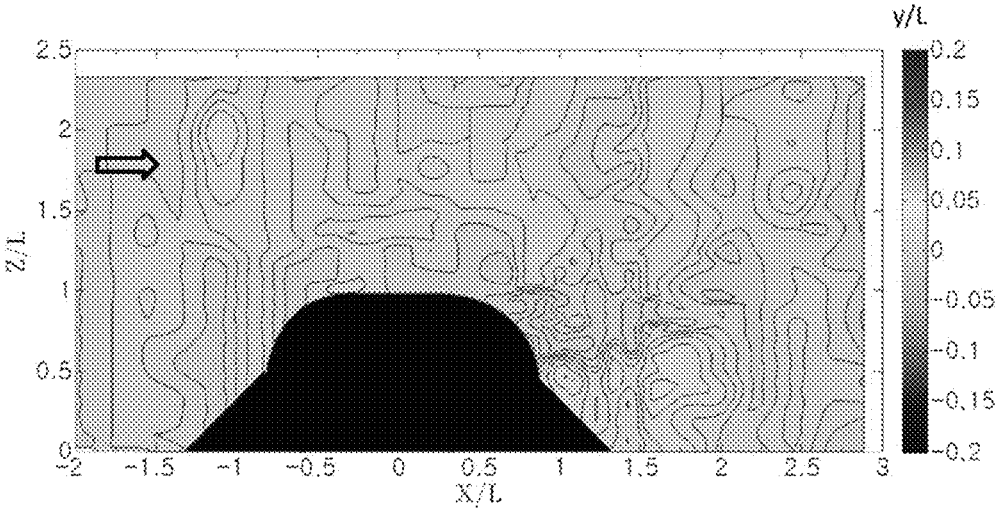
FIG. 13 shows bed level change contours at streamwise X and spanwise Y locations after and before flow around the fairing with modified sharp edge spill-through model with VGs (L=229 mm).

FIG. 11 is a surface oil flow for this case that clearly shows that the fairing and VG products bring lower velocity flow up from the flume bottom and prevent scour around the bottom of the abutment (Simpson et al. 2013). FIG. 12 shows the deep scour holes for the unmodified spill-through abutment. With a fairing modified spill-through abutment with VGs, FIG. 13 shows no scour around the upstream contraction and near the base of the modified spill-through abutment due to the fairing. Although there is still a very minor scour at the downstream of the model, its max depth (−0.02 L) is much lower than that for an untreated abutment. The downstream open bed scour due to the free surface vortex has been greatly reduced.

Figure 14:
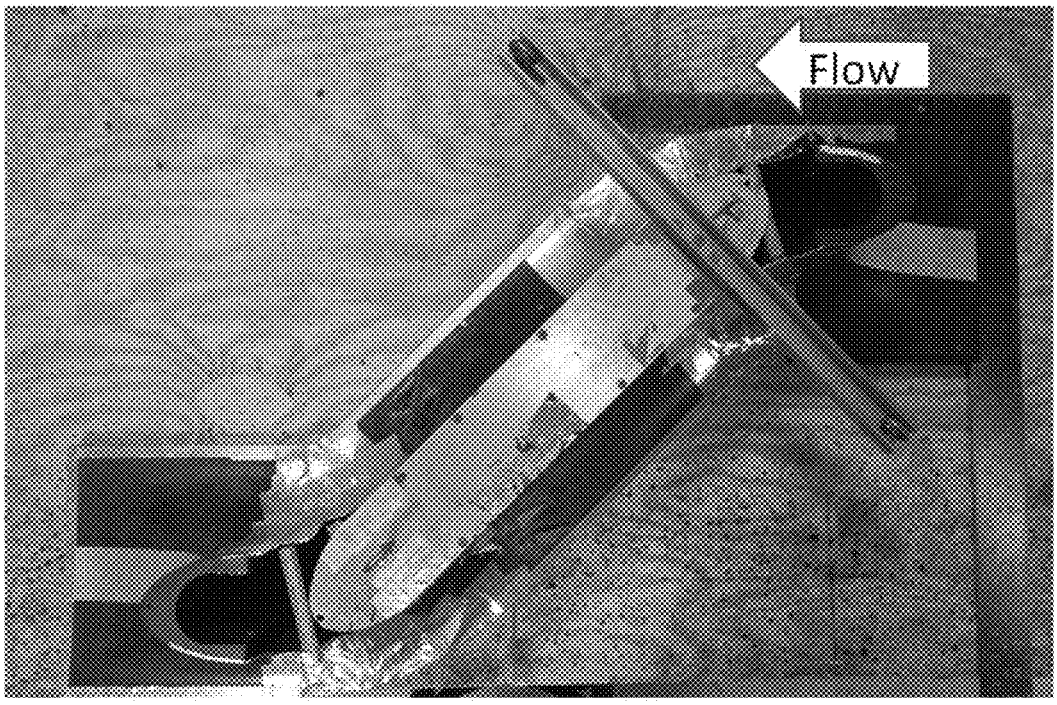
FIG. 14 is a top view of the fairing for a 45° dogleg configuration.

Example for Bridge Piers and Abutments at High Angles of Attack—45 Deg Dogleg Configuration Here an extension is disclosed for bridge piers and abutments at larger angles of attack of up to 45°. Nose and tail extension sections on a pier form a dogleg shape (FIG. 14) and vortex generators prevent separations. The center-line of the piece-wise continuously varying slope and curvature curved pier nose and tail extensions and the nose and tail of the fairing are aligned with the on-coming flow direction. VGs are used to energize the near-wall flow upstream of the adverse pressure gradient regions around the pier and prevent separation and scour.

Figure 15A:
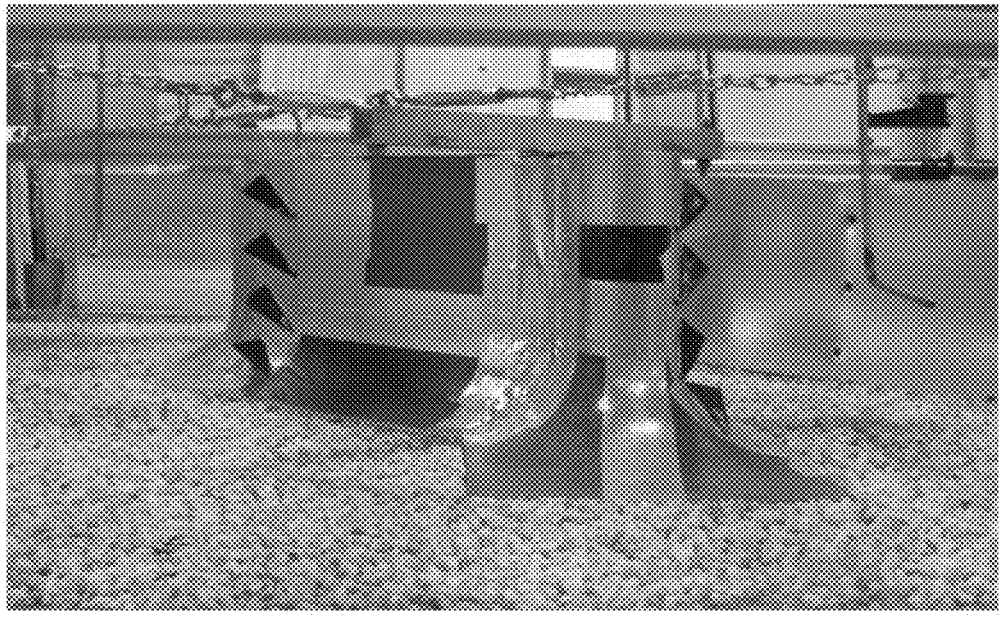
FIG. 15*a* is an upstream view showing location of VGs on a pier model front right and rear left sides used in 45 degree high angle-of-attack AUR flume tests.
Figure 15B:
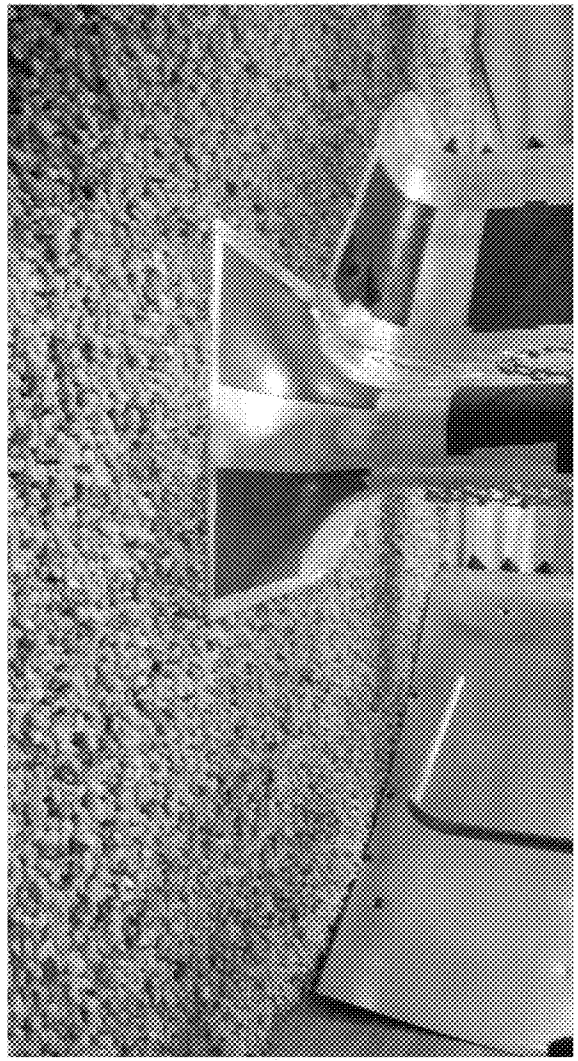
FIG. 15*b* is a downstream view of AUR model used in 45° high angle-of-attack AUR flume tests with a laser sheet showing no scour downstream of the model.

Model scale experiments in the AUR flume were performed that confirm that this design prevents scour. The VGs are attached on both front and rear fairings as shown in FIGS. 15*a* and 15*b*. The VGs are 76 mm long and 19 mm high. The free-stream velocity is 0.58 m/s and the flow speed near the VGs on the fairings is about 0.61 m/s, which caused scour when the VGs were not used. As shown in the photos below, there is no scour around the model.

Manufacturing and installation processes and methods would be the same as for bridges at lower angles of attack that do not need the dogleg. However there are increases in costs due to the addition of the additional components required for the stainless steel dogleg on a pier (Simpson 2013).

Example of Fairing with VG for a Swirling River Downstream of a Bend

Here, another extension is disclosed for bridge piers and abutments downstream of a bend in a river where there is large-scale swirling approach flow produced by the river bend. The fully three-dimensional shape is modified from the straight ahead case to meet the first requirement of the design that the stream-wise gradient of surface vorticity flux must not exceed the vorticity diffusion or transport rate in the boundary layer, thus preventing the formation of a discrete vortex. Another requirement is that a minimal size of the fairing be used that meets the first requirement.

Figure 16:
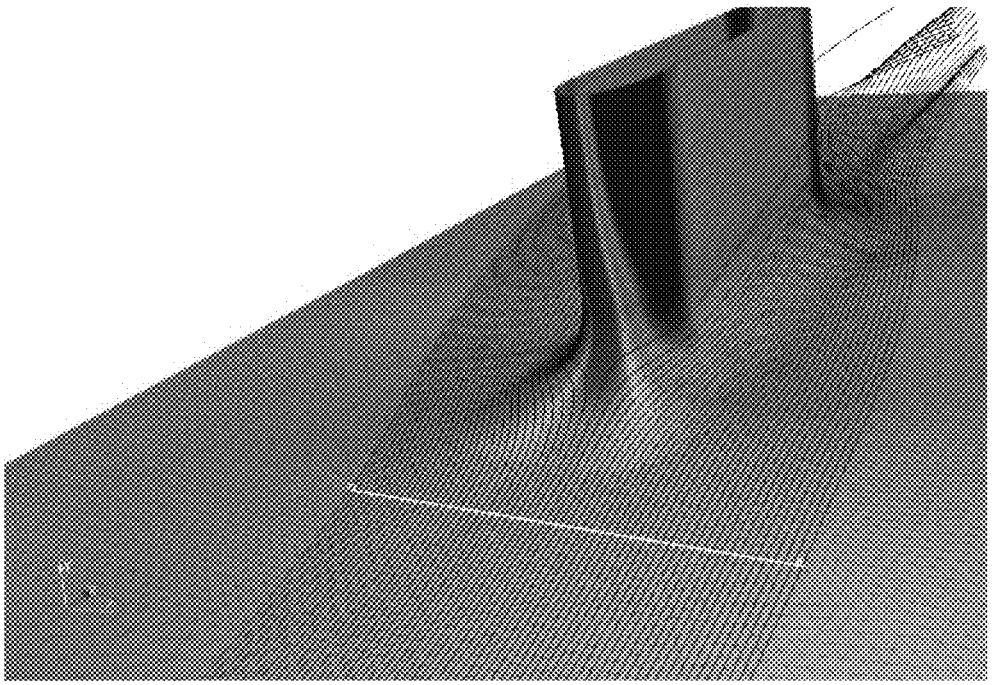
FIG. 16 shows the flow downstream of a 90° river bend from computational fluid dynamics (CFD); near-wall streamlines start at X/D=−4 and Y/D=0.13, where X/D and Y/D are streamwise X and spanwise Y locations divided by the pier width D.
Figure 17:
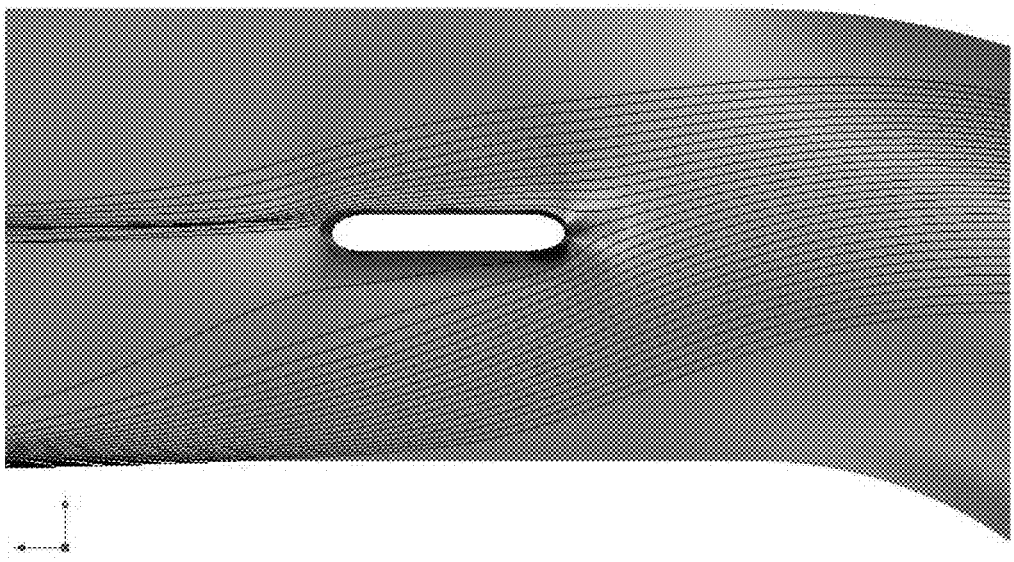
FIG. 17 is a top view of flow downstream of a 90° river bend from computational fluid dynamics (CFD); near-wall streamlines start at X/D=−4 and Y/D=0.13, where X/D and Y/D are streamwise X and spanwise Y locations divided by the pier width D.
Figure 18:
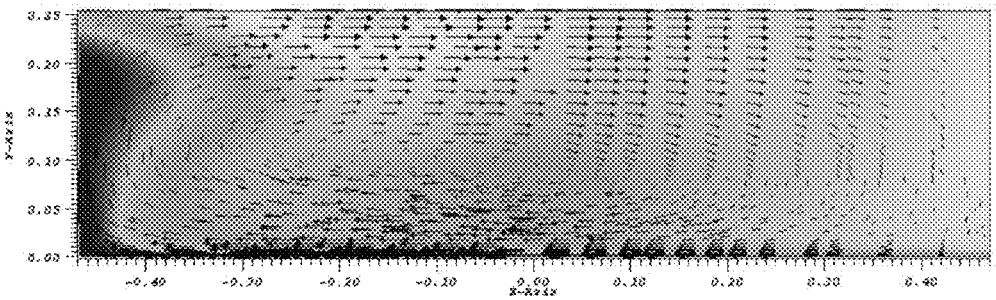
FIG. 18 shows a cross-section of the swirling secondary flow from CFD downstream of a 90° bend at the streamwise X divided by the pier width D or X/D=−0.30, but upstream of a pier; river surface flow at top of figure moves toward outer river bank on right; near-wall flow moves toward inner river bank on left.

FIGS. 16-18 show results for a thick upstream inflow boundary layer. The pier is located downstream of a 90° river bend. Pier model width D is 0.076 m wide with a 27.5 mps flow. The inflow boundary layer thickness=0.25 m. The near-river bottom flow moves toward the inner curved river bank under the large pressure gradient between the inner and outer river banks. The near free-surface flow moves toward the outer curved river bank under the effect of flow inertia. A large stream-wise vortex across the entire river is produced by the end of the curved section of the river.

This swirling flow is the upstream inflow to the pier. This inflow allows one to modify the nose shape from the straight ahead case shape and meet the vorticity flux requirement mentioned above. There is no separation or rollup of a discrete vortex that will cause scour.

Example Foundation Scour Vortex Prevention Device: The Curved Leading Edge Ramp

Aspects of the fairing and VG design features have been expanded by using a curved leading edge ramp in front of a pier or abutment foundation in order to further protect the foundation from the effects of contraction scour, long term degradation scour, settlement and differential settlement of footers, undermining of the concrete faring segments, and effects of variable surrounding bed levels. This leading edge ramp prevents undermining of the foundation when the fairing and VG products are installed on a pier or abutment.

First, when the fairing and VG design features are installed on a bridge pier or abutment, the fairing prevents any scouring horseshoe vortex formation and down flow of higher velocity water from upstream and the VGs cause low speed water flow near the river bottom next to the pier or abutment to move up the pier or abutment, as shown in FIGS. 8 and 11. Thus, the velocities, shearing stresses on the bottom of the pier or abutment, and pressure gradients will be lower than without the fairing and VG. Presumably the surrounding river bed will be at the same height or level as the top edge of the fairing at the bottom of the pier or abutment after installation. As all AUR flume studies have shown, under these conditions scour of the open bed material occurs at a lower river speed before scour of the material around the base of the fairing occurs.

What this means is that scour of the river bed away from the fairing protected pier or abutment will occur first and that the river bed level will be lower away from the pier or abutment. If a pier or abutment foundation is exposed, it will still have a higher immediate surrounding river bed level than farther away. Even so, it is desirable to further arrest scour around the foundation to prevent high speed open bed scour from encroaching on the river bed material next to the foundation.

Second, if the front or upstream part of the foundation of a pier or abutment is exposed to approach flows, then a foundation horseshoe or scouring vortex is formed at the front which will cause local scour around the pier or abutment. This suggests that a curved ramp be mounted in front of the foundation to prevent the formation of this foundation horseshoe vortex. Additional components around the sides of the foundation are also another consideration, but because they do not produce a flow that moves up the fairing, they will not produce any benefit.

Based on these facts, flume tests were conducted with 3 foundation leading edge ramp configurations: (1) an exposed rectangular foundation with no front ramp protection, (2) an upstream curved foundation ramp with trapezoidal spanwise edges to produce a stream-wise vortex to bring open bed materials toward the foundation, and (3) a curved upstream foundation ramp with straight span-wise edges. Gravel A, which is the smallest gravel used in the AUR flume and has a specific gravity of 3.7 and the size of 1.18-1.4 mm, are distributed around the faring model for each test.

Figure 19:
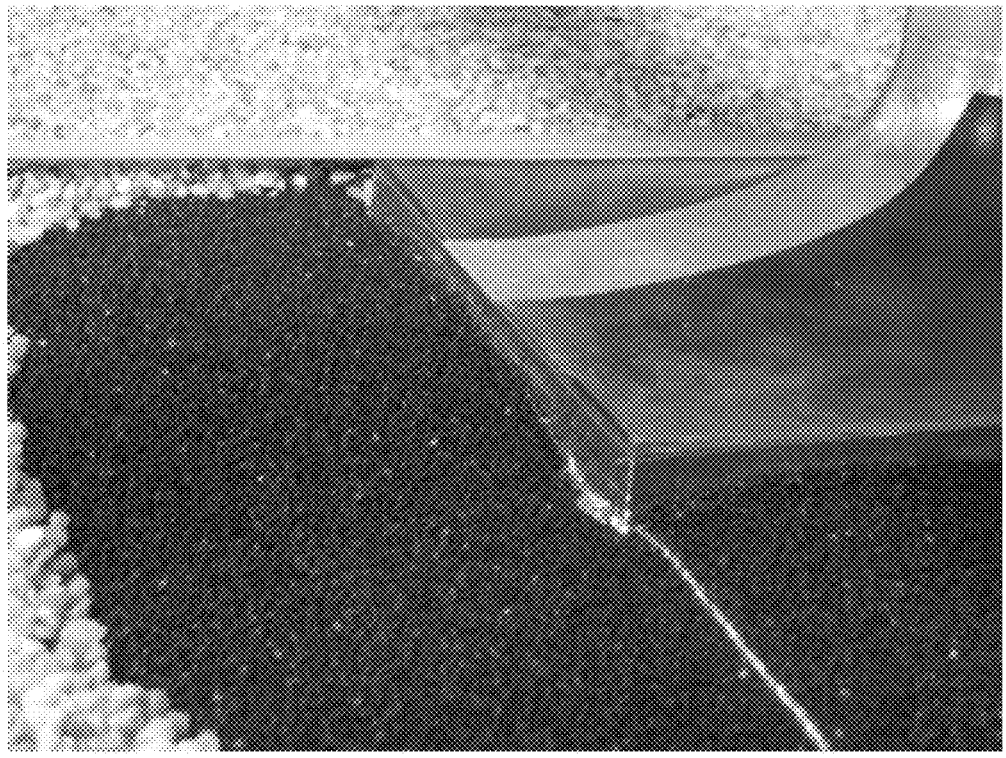
FIG. 19 shows the gravel level after model flume test for a H=12.7 mm high foundation elevation for a pier of width D (H/D=⅙) without a leading edge ramp and a scour hole at corner of foundation due to horseshoe vortex around foundation; note laser sheet for gravel surface measurement.

Flume tests for scour depth were made for these 3 cases with H=12.7 mm high foundation elevation (H/D=⅙) with gravel A around the foundation with or without a leading edge ramp (Simpson 2013). These tests were done with a flow speed of 0.6 mps at which the pea gravel in the open bed begins to be carried downstream. Without a ramp, as expected, the scour occurred at the front corners of the model due to the front foundation horseshoe vortex, as shown in FIG. 19. There is gravel accumulation along the pier side near the location of VGs on the fairing on the pier, which is caused by the horseshoe vortices and downstream upflow generated by these VGs.

For the H=12.7 mm high foundation (H/D=⅙) with a curved ramp and trapezoidal sides, the scour occurs at the front corner of the ramp and more gravel accumulates along the pier side around the VGs (Simpson 2013). Furthermore, there is a gravel mound at the downstream model edge. The gravel carried from the upstream are accumulated along the pier side and at the pier end. Therefore, the tested trapezoidal front ramp is not effective to reduce or prevent the scour at the upstream end of the foundation when the edge of the foundation is higher than the surrounding bed.

Figure 20:
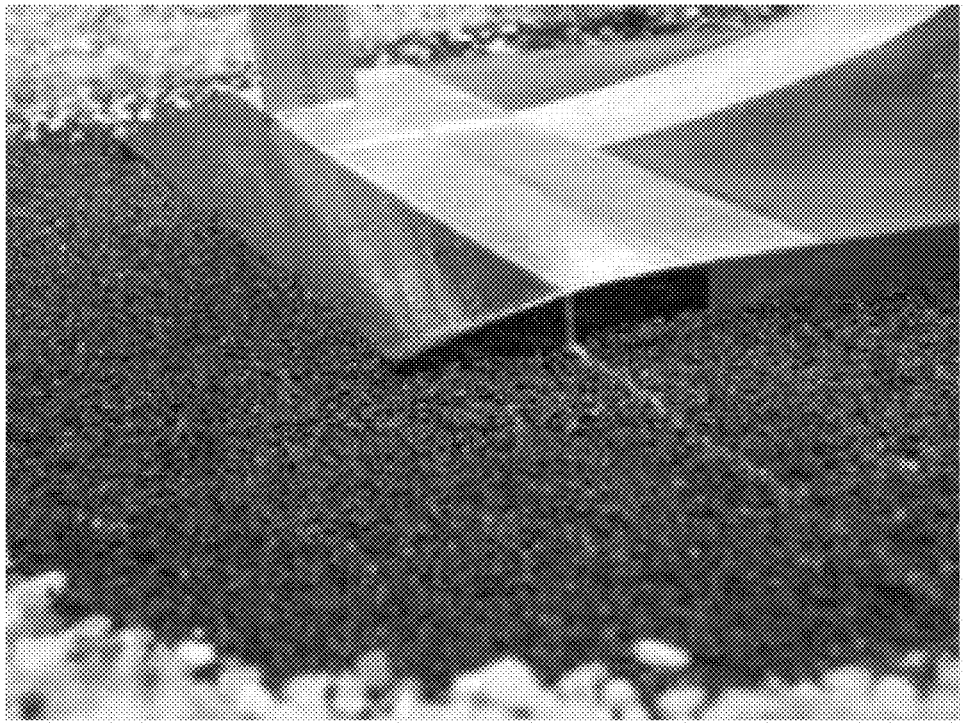
FIG. 20 shows the gravel level after flume test for a H=12.7 mm high foundation elevation for a pier of width D (H/D=⅙) with a 19 mm high straight-sided curved leading edge ramp buried 6.4 mm in the gravel; note no scour around foundation.

For the H=12.7 mm high elevation (H/D=⅙) with 19 mm high curved straight-sided ramp, scour around the front of the foundation is not detectable (FIG. 20) since the ramp is submerged 6.4 mm and the blunt nose of the ramp is not exposed to the flow. The scour hole and mound along the side is also minimized. The scour hole along the pier side is away from the pier foundation several piers heights and the gravel accumulate on the pier side downstream of the VG. This is a desired result since no gravel next to the foundation is removed. To the contrary, downstream of the VGs gravel from the open bed is brought toward the foundation edge, which serves to further protect the foundation from further scour. Results for a 19 mm high foundation produced very similar results (Simpson 2013). In summary, all of these foundation tests show that a leading edge straight-sided curved ramp prevents scour around a foundation when there is open bed scour.

Figure 21:
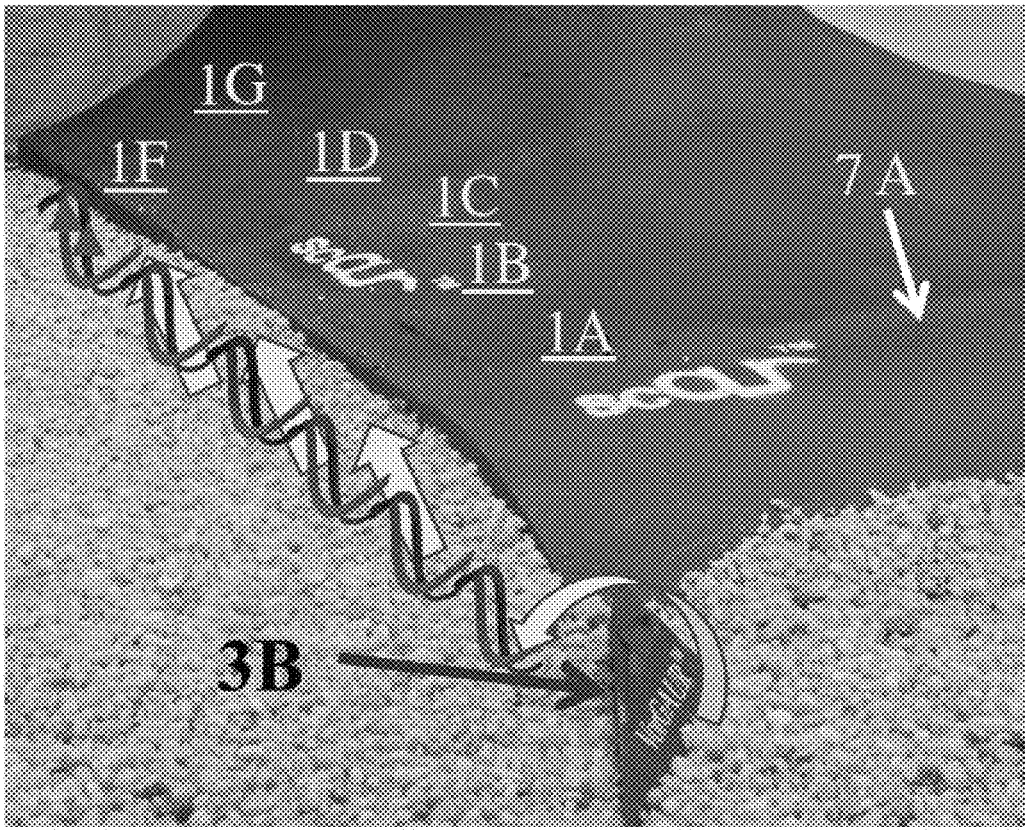
FIG. 21 illustrates that a vortex generator at left upstream ramp (7A) corner creates a counterclockwise (CCW) vortex that brings open-bed scour gravel toward the foundation. Here individual sections or pieces of surface (1A), (1B), (1C), (1D), (1F), and (1G) individually have a continuously varying slope and curvature surface and intersect adjacent pieces or sections to form the piecewise continuously varying slope and concave-convex-curvature surface of the nose.

Example of Initially Submerged Pier and Abutment Vortex Generators to Protect a Foundation from Open-Bed Scour In addition to the curved leading edge ramp mentioned above, a further innovation to protect a foundation from open-bed scour uses a vortex generator at 20° angle of attack in front of each leading edge corner of the ramp, which will create a vortex that brings available loose open-bed scour materials toward the pier or abutment foundation to protect the pier or abutment, as shown in FIG. 21 for a pier. Like for the ramp, when there is no high velocity flow and the curved leading edge ramp (7) is covered with river bed material, the vortex generators (3B) are also covered with bed material. When the water flow speed approaching the pier or abutment is large enough to cause open-bed scour, the bed material over the curved leading edge ramp and the vortex generators will eventually be removed exposing both the ramp and vortex generators. Both the curved leading edge ramp and the vortex generators create vortices that bring loose open-bed material toward the foundation to further protect it from scour.

Another innovation uses VGs (3C) mounted on the sides of the foundation to bring more available loose open-bed scour materials toward the pier or abutment foundation to protect further the pier or abutment. These VGs are initially submerged below the surface of the river bed, but are exposed when there is high velocity flow and open-bed scour. Properly oriented, they create vortices that bring open-bed scour material towards the foundation for protection.

Example Pier and Abutment Stern or Tail Fairings to Further Prevent Scour

Figure 22:
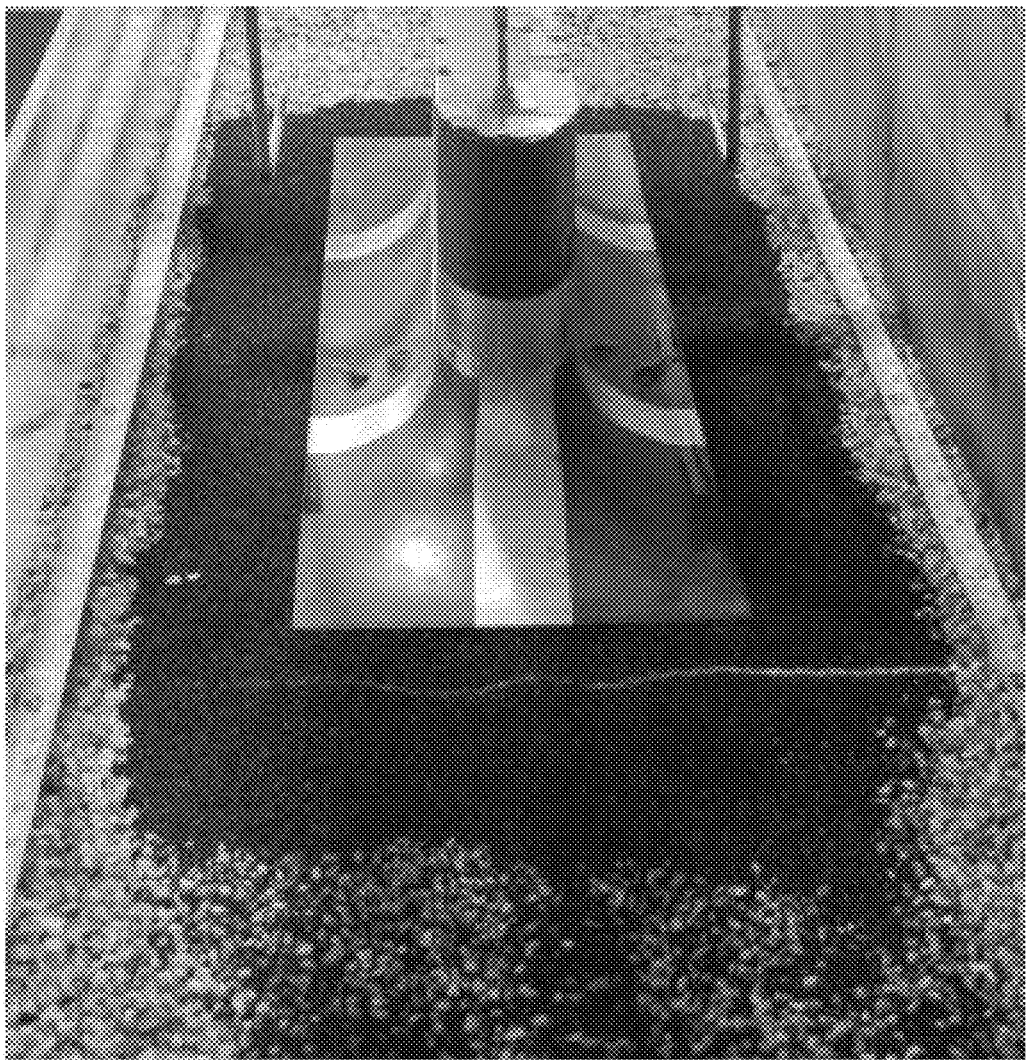
FIG. 22 shows an example of a pier in close proximity to adjacent piers or abutments with scour at the downstream of the fairing with VGs model without a tail. Laser light sheet shows scour hole downstream of the pier on both sides of centerline and a scour mound along the centerline.

When a pier is in close proximity to an adjacent pier or abutment, the flow between the two hydraulic structures is at a higher speed than if they were further apart. This means that at the downstream region of the pier or abutment there will be a greater positive or adverse stream-wise pressure gradient, which will lead to more and stronger flow separation (FIG. 22). To reduce this separation and possibilities for scour, a more gradual fairing or tail can be used, as shown in FIG. 23 for a pier. A similar more gradual fairing can be used for abutments.

The test with a narrow flume width was conducted without a tail first in order to compare with the tail case. The upstream free-stream flow is 0.56 m/s and the flow speed is about 0.66-0.67 m/s between the model and the side wall. After 50 minutes the scour holes downstream of the model are symmetric on each side of the centerline and are caused by the separated vortices from the rear fairing, as shown in FIG. 22. The corresponding scour deposition mound is located along the centerline. A video clip was recorded for this scour development.

A tail is attached to the rear fairing as shown in FIG. 23 in order to prevent the separation from the rear fairing which causes this scour hole at the downstream of the model. The tail in this example is a NACA0024 airfoil that is 76 mm thick which is the width of the model pier, 178 mm long and 203 mm high.

The tail on the model was tested with the same flume conditions as without a tail, 0.56 m/s free-stream velocity and 0.66-0.67 m/s between the model and the side wall. After a 50 minutes run with the same flow speed as before, there are only very minor scour holes generated at the downstream of the model.

Examples of Additional Construction and Mold Materials and Piece-Wise Continuous Concave-Convex Curvature Surfaces In an extension to Simpson et al., in addition to the concrete or fiber-reinforced composite, or combination thereof, hydrodynamic fairing disclosed in that patent, the present invention in practice is a cast-in-place, pre-cast, or sprayed ("shotcrete") concrete, metal, or composite material, or combinations thereof, hydrodynamic fairing that is fit or cast over one or more existing or new hydraulic structures around the bases of these structures and above and around their footings. Molds for the concrete or composite fairing are made from wood and other natural materials, metal or composite materials, or combinations thereof. Such a properly designed fairing, as described by Simpson et al., prevents scouring vortex formation for both steady and unsteady flows, including oscillatory tidal flows. The product is manufactured using existing metal, concrete, and composite materials technologies well known to professionals. As such, the product can be produced at minimal cost and with high probability of endurance over a long future period.

While the shape of the fairing for bridge piers and abutments is fully three-dimensional, as described in detail by Simpson et al., it can be approximated by piece-wise continuously varying slope and concave-convex-curvature surfaces within definable tolerances that produce similar scouring vortex prevention effects as continuously varying slope and concave-convex-curvature surfaces. No scouring vortices are produced in either case, but the piece-wise continuously varying slope and curvature version can be manufactured at a much lower cost.

Retrofit Bridge Pier and Abutment Fairing

An attractive manufacturing alternative for a retrofit bridge fairing uses stainless steel (SS) or even weathering steel. Stainless steel was considered for both the double curvature end sections and the cylindrical sides of the fairing. Its corrosion resistance gives it a lifetime of 100 years even in seawater environments, using a proper thickness, construction methods, and type of SS. It is an effective way to reduce weight and the cost associated with casting custom reinforced concrete structures. Another benefit is that the SS VGs can be welded directly onto the side sections instead of having to be integrated into the rebar cage of a reinforced concrete structure.

Typical example costs for each of these manufacturing approaches were developed from current cost information and quotations from concrete and steel fabricators. It is clear that stainless steel is the best choice for bridge retrofits.

Figure 25:
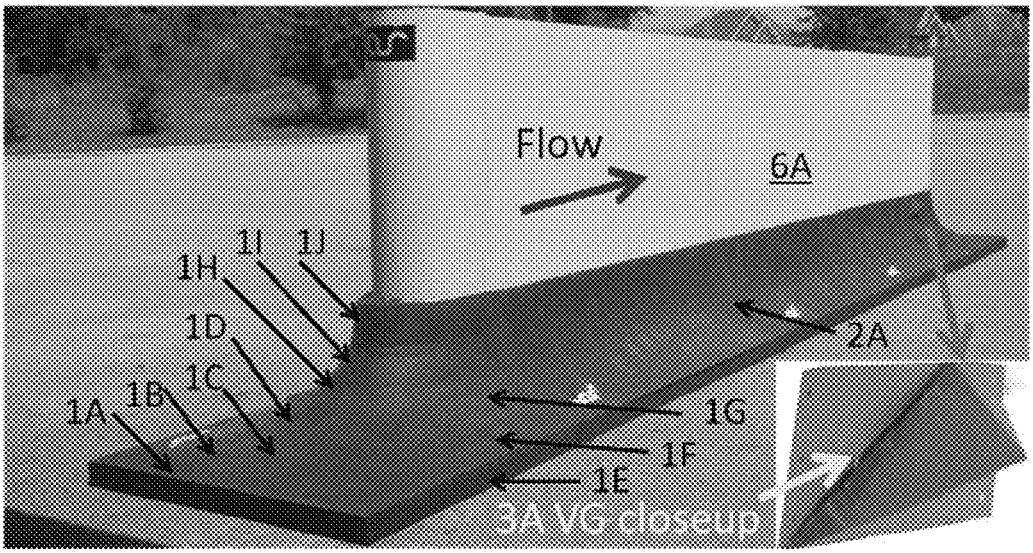
FIG. 25 illustrates an example of a stainless steel piece-wise continuous surface retrofit fairing for a pier (6A) consisting of individual sections or pieces of surface (1A), (1B), (1C), (1D), (1E), (1F), (1G), (1H), (14 and (1J) for the nose and with VGs (3A) (all shown in black) for the side (2A). VGs (3A) create vortices that bring low-speed flow up to prevent scour.

FIGS. 24 and 25 show a full-scale sheet stainless steel retrofit with pier fairing with piece-wise continuously varying slope and concave-convex-curvature surfaces within definable tolerances that produce the same effects as continuously varying slope and concave-convex-curvature surfaces. FIG. 26-30 show full-scale sheet stainless steel retrofit fairings with piece-wise continuously varying slope and concave-convex-curvature surfaces for a wing-wall and spill-through abutments. These fairings and VGs for a dogleg pier and a pier with a tail fairing are within definable tolerances that produce the same effects as continuously varying slope and concave-convex-curvature surfaces. Bulkheads under the sheet-metal skin support the piece-wise continuously varying slope and concave-convex curvature surface.

FIGS. 24, 29, and 30 show the leading edge ramp (7) for piers. FIGS. 24-30 show scour preventing vortex generators 3A, 3B, and 3C for piers and abutments.

New Construction

In the case with new construction, essentially the difference between the way cast-in-place bridge piers and abutments are constructed currently without the fairing and in the future with the fairing products, is that steel forms for the concrete are used, as shown in FIGS. 31-34, 36, and 37 for piers and abutments. All standard currently used concrete construction methods and tools can be used. During the bridge design phases, the bridge pier or abutment foundation or footer top surface width and length would need to be large enough to accommodate the location of the concrete fairing on top. Rebar needed for the fairing would be included in the foundation during its construction. Stainless steel rebar for welding to the stainless steel vortex generators mounting plates on the surface need to be used for specific locations.

Standard methods for assembling forms and pouring the concrete will be used, as discussed in ACI 318-11. The contractor simply needs to replace the currently used forms for the lowest level of the pier or abutment above the foundation with the fairing forms. The fairing steel forms can be mounted and attached to the foundation forms. The tops of the steel fairing forms on opposite sides of a pier can be attached together with steel angle to completely contain the concrete for the foundation and the fairing. Like current methods, after the fairing and foundation concrete has cured sufficiently, the fairing and foundation forms would be removed. Currently used forms for the next higher portions of the pier or abutment can then be mounted in place for further cast-in-place concrete. Estimated incremental costs of adding the fairing to new construction for additional rebar, concrete, labor, fairing forms, and transportation of forms for various width pier construction shows that the new construction cost is about ⅓ of retrofit costs, so the best time to include the fairing on piers is during new construction.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

REFERENCES

American Concrete Institute (ACI) Committee 318. *"ACI 318-11: Building code requirements for Structural Concrete."* ACI Standard, 2011.

Barkdoll, B. D., Ettema, R., and B. W. Melville, *Countermeasures to Protect Bridge Abutments from Scour*, NCHRP Report 587, pp. 1-3, 2007.

Ettema, R., Yoon, Byungman, Nakato, Tatsuaki and Muste, Marian, *A review of scour conditions and scour-estimation difficulties for bridge abutments*, KSCE Journal of Civil Engineering, Volume 8, Number 6, Pages 643-65, 2004.

Lagasse, P., Zevenbergen, L., Schall, J., and Clopper, P., *Bridge Scour and Stream Instability Countermeasures*. FHWA Technical Report Hydraulic Engineering Circular (HEC)-23, (3.10~11 pages 66-67), 2001.

Hunt, B., *Monitoring Scour Critical Bridges*, NCHRP Synthesis 396, pages 1-2, 2009.

Richardson, E. V. and Davies, S. R. *Evaluating scour at bridges*. FHWA NHI 01-001 HEC-18, Federal Highway Administration, US DOT, Washington, D.C., section 1.1, 2001.

Sheppard, D. M., Demir, H., and Melville, B., *Scour at Wide Piers and Long Skewed Piers*, NCHRP-Report 682, page 26, 2011.

Simpson, R. L., *Full-Scale Prototype Testing and Manufacturing and Installation Plans for New Scour-Vortex-Prevention scAUR™ and VorGAUR™ Products for a Representative Scour-critical Bridge*, NCHRP-IDEA Report 162, 2013.

Simpson, R. L., *Junction Flows*, Annual Review of Fluid Mechanics, Vol. 33, pp. 415-443, 2001.

Tian, Q. Q., Simpson, R. L., and Lowe, K. T., *A laser-based optical approach for measuring scour depth around hydraulic structures,* $5^{th}$ International Conference on Scour and Erosion, ASCE, San Francisco, Nov. 7-11, 2010.

What is claimed is:

1. A fairing for a hydraulic structure comprising:

a. a piece-wise continuously varying slope and curvature streamlined fairing surface installed around a perimeter of the hydraulic structure and extending from above a river to a bed of the river surrounding the hydraulic structure, the piece-wise continuously varying slope and curvature fairing completely enveloping the hydraulic structure and providing a piece-wise continuously varying slope and curvature faired shape in a direction of flow of the river, wherein the piece-wise continuously varying slope and curvature streamlined fairing surface comprises a plurality of continuously varying slope and curvature surfaces that are assembled together to form the piece-wise continuously varying slope and curvature streamlined fairing surface, and wherein the discontinuity in the piece-wise continuously varying slope and curvature streamlined fairing surface occurs at the intersection of the plurality of the continuously varying slope and curvature surfaces; and b. at least one vortex generator attached to the piece-wise continuously varying slope and curvature fairing surface.

2. The faring of claim 1, wherein a plurality of vortex generators are placed along a longitudinal distance of a stem to stern dimension of said piece-wise continuously varying slope and curvature fairing surface, and being proximal to the bed of the river in a flow region void of adverse pressure gradients that would persist downstream of said vortex generator for at least one length of said generator.

3. The fairing of claim 1, wherein the hydraulic structure is a pier or an abutment.

4. The fairing of claim 3, wherein the pier is a straight pier or a dogleg pier.

5. The fairing of claim 3, wherein the abutment is a wing-wall abutment or a spill-through abutment.

6. The fairing of claim 1, wherein the hydraulic structure is a pier and said vortex generators are positioned on opposed surfaces thereof.

7. The fairing of claim 1, wherein said vortex generators are tetrahedral in shape and include four triangular faces, three of which meet at each vertex.

8. The fairing of claim 1, wherein said vortex generators are constructed of cast-in-place concrete, pre-cast concrete, sprayed concrete, metal, composite, fiber reinforced polymers, or combinations thereof.

9. The fairing of claim 1, wherein the piece-wise continuously varying slope and curvature streamlined fairing surface is constructed of cast-in-place concrete, pre-cast concrete, sprayed concrete, metal, composite, fiber reinforced polymers, or combinations thereof.

10. The fairing of claim 1, wherein the fairing is fit or cast over one or more existing or new hydraulic structures around the base of these structures and above and around their footings.

11. The fairing of claim 1, wherein the plurality of continuously varying slope and curvature surfaces are premanufactured and interlock using matching keys or alignment surfaces among individual premanufactured elements.

12. The fairing of claim 1, wherein a nose section and a stern section are symmetrical.

13. The fairing of claim 1, wherein the fairing comprises asymmetrical rounded nose section and tapered stern section.

14. A method for forming a fairing for a hydraulic structure comprising the steps of:

a. installing a piece-wise continuously varying slope and curvature streamlined fairing surface around a perimeter of the hydraulic structure and extending from above a river to a bed of the river surrounding the hydraulic structure, the piece-wise continuously varying slope and curvature fairing completely enveloping the hydraulic structure and providing a piece-wise continuously varying slope and curvature faired shape in a direction of flow of the river, wherein the piece-wise continuously varying slope and curvature streamlined fairing surface comprises a plurality of continuously varying slope and curvature surfaces that are assembled together to form the piece-wise continuously varying slope and curvature streamlined fairing surface, and wherein the discontinuity in the piece-wise continuously varying slope and curvature streamlined fairing surface occurs at the intersection of the plurality of the continuously varying slope and curvature surfaces; and b. attaching at least one vortex generator to the piece-wise continuous fairing surface.

15. The method of claim 14, wherein The fairing of claim 1, wherein a plurality of vortex generators are placed along a longitudinal distance of a stem to stern dimension of said piece-wise continuously varying slope and curvature fairing surface, and being proximal to the bed of the river in a flow region void of adverse pressure gradients that would persist downstream of said vortex generator for at least one length of said generator.

16. The method of claim 14, wherein the hydraulic structure is a pier or an abutment.

17. The method of claim 16, wherein the pier is a straight pier or a dogleg pier.

18. The method of claim 16, wherein the abutment is a wing-wall abutment or a spill-through abutment.

19. The method of claim 14, wherein the piece-wise continuously varying slope and curvature streamlined fairing surface is constructed of cast-in-place concrete, pre-cast concrete, sprayed concrete, metal, composite, fiber reinforced polymers, or combinations thereof.

20. The method of claim 14, wherein the plurality of continuously varying slope and curvature surfaces are premanufactured and interlock using matching keys or alignment surfaces among individual premanufactured elements.

* * * * *